US011988220B2

(12) United States Patent
Lin et al.

(10) Patent No.: US 11,988,220 B2
(45) Date of Patent: May 21, 2024

(54) VOLUTE ASSEMBLY AND INDUCED DRAFT FAN COMPRISING THE SAME

(71) Applicant: Zhongshan Broad-Ocean Motor Co., Ltd., Zhongshan (CN)

(72) Inventors: Yanhu Lin, Zhongshan (CN); Miao Zhang, Zhongshan (CN); Liewei Guo, Zhongshan (CN); Hongbin Wang, Zhongshan (CN); Jianwei Zha, Zhongshan (CN); Zhihan Wu, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 289 days.

(21) Appl. No.: 17/523,892

(22) Filed: Nov. 10, 2021

(65) Prior Publication Data

US 2022/0065261 A1 Mar. 3, 2022

Related U.S. Application Data

(63) Continuation-in-part of application No. PCT/CN2020/084037, filed on Apr. 9, 2020.

(30) Foreign Application Priority Data

| | | |
|---|---|---|
| Dec. 17, 2019 | (CN) | 201922266747.2 |
| Nov. 16, 2020 | (CN) | 202011278154.9 |
| Nov. 16, 2020 | (CN) | 202022642444.9 |

(51) Int. Cl.
*F04D 29/42* (2006.01)
*F04D 29/08* (2006.01)
(Continued)

(52) U.S. Cl.
CPC ..... *F04D 29/281* (2013.01); *F04D 29/083* (2013.01); *F04D 29/4226* (2013.01); *F04D 29/661* (2013.01)

(58) Field of Classification Search
CPC ..... F04D 29/4226
See application file for complete search history.

(56) References Cited

U.S. PATENT DOCUMENTS 10,050,496 B2 * 8/2018 Lei ..... F04D 25/0606
10,495,112 B2 * 12/2019 Duquette ..... F04D 17/10
(Continued)

FOREIGN PATENT DOCUMENTS

CN 1757932 A 4/2006
CN 203384069 U 1/2014
(Continued)

*Primary Examiner* — Sabbir Hasan
(74) *Attorney, Agent, or Firm* — MATTHIAS SCHOLL P.C.; Matthias Scholl

(57) ABSTRACT

A volute assembly includes a volute body, a cover plate, and a seal. The volute body includes a top plate, a side plate protruding axially from an edge of the top plate, a cavity formed by the top plate and the side plate, and an exhaust duct disposed on the side plate and communicating with the cavity. The side plate includes a first bottom edge and a plurality of clamping blocks disposed at intervals on the first bottom edge. The cover plate includes a bottom plate and an annular sleeve surrounding the bottom plate. The annular sleeve includes a second bottom edge and a flange protruding from the second bottom edge. The flange includes a plurality of buckles disposed at intervals. The seal is disposed around the annular sleeve and is supported by the flange. The side plate is matched with the annular sleeve in shape.

19 Claims, 27 Drawing Sheets

(51) Int. Cl.
*F04D 29/28* (2006.01)
*F04D 29/66* (2006.01)

(56) References Cited

U.S. PATENT DOCUMENTS

| | | | | |
|---|---|---|---|---|
| 2014/0332003 | A1* | 11/2014 | Crumblin | A61M 16/0875 128/207.14 |
| 2019/0085863 | A1* | 3/2019 | Lin | F04D 17//16 |
| 2021/0115937 | A1* | 4/2021 | Lin | F04D 29/083 |
| 2022/0082111 | A1* | 3/2022 | Chen | F04D 29/626 |

FOREIGN PATENT DOCUMENTS

| | | | |
|---|---|---|---|
| CN | 206830525 | U | 1/2018 |
| CN | 207018245 | U | 2/2018 |
| CN | 109399214 | A | 3/2019 |
| JP | 2002138991 | A | 5/2002 |
| JP | 5353864 | B2 | 11/2013 |
| WO | 2019082378 | A1 | 5/2019 |

* cited by examiner

VOLUTE ASSEMBLY AND INDUCED DRAFT FAN COMPRISING THE SAME

CROSS-REFERENCE TO RELATED APPLICATIONS

This application is a continuation-in-part of International Patent Application No. PCT/CN2020/084037 with an international filing date of Apr. 9, 2020, designating the United States, and further claims foreign priority benefits to Chinese Patent Application No. 201922266747.2 filed Dec. 17, 2019, to Chinese Patent Application No. 202011278154.9 filed Nov. 16, 2020, and to Chinese Patent Application No. 202022642444.9 filed Nov. 16, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a volute assembly and an induced draft fan comprising the same.

Referring to FIG. 1, a conventional volute assembly includes a volute body 10A and an annular cover plate 20A. The volute body 10A includes a recess at one end configured to fix the cover plate 20A. The cover plate 20A is fastened to the volute body 10A with a plurality of screws. The volute assembly is simple in structure, but the installation process thereof is time-consuming because the cover plate needs to be fastened with a plurality of screws, thus reducing the assembly and disassembly efficiency of an induced draft fan including the volute assembly. Referring to FIG. 2, the volute assembly also includes a first inner wall surface 1A, a second inner wall surface 2A, and a third inner wall surface 3A, all of which are plane surfaces and connected to each other to form a flow channel; the third inner wall surface 3A is perpendicular to the first inner wall surface 1A and the second inner wall surface 2A. The junction between the first inner wall surface 1A and the third inner wall surface 3A is rounded and the junction between the second inner wall surface 2A and the third inner wall surface 3A is rectangular. In this way, the airflow generated by a wind wheel tends to hit the inner wall surface of the volute body, resulting in unsmooth airflow and uneven distribution of airflow pressure in the flow channel. However, the distances between the three inner wall surfaces and the wind wheel and the discharge airflow area of the wind wheel are unchanged, which results in low operating efficiency, airflow loss caused by the sudden increase of the cross-sectional area of the air outlet, big noise, and vibration of the whole machine.

SUMMARY

The disclosure provides a volute assembly comprising a volute body, a cover plate, and a seal.

The volute body comprises a top plate, a side plate protruding axially from an edge of the top plate, a cavity formed by the top plate and the side plate, and an exhaust duct disposed on the side plate and communicating with the cavity; the side plate comprises a first bottom edge and a plurality of clamping blocks disposed at intervals on the first bottom edge.

The cover plate comprises a bottom plate and an annular sleeve surrounding the bottom plate; the annular sleeve comprises a second bottom edge and a flange protruding from the second bottom edge; the flange comprises a plurality of buckles disposed at intervals; the seal is disposed around the annular sleeve and is supported by the flange.

The side plate is matched with the annular sleeve in shape; when the cover plate is disposed on the volute body, the annular sleeve is nested in the side plate and the plurality of clamping blocks is secured to the plurality of buckles, respectively, to fasten the cover plate to the volute body, whereby the seal abuts against the side plate and the flange, achieving a sealing effect.

In a class of this embodiment, the flange comprises a first flange protruding radially outward and a second flange protruding from an edge of the first flange; the first flange, the second flange, and an outer wall of the annular sleeve form a groove; the seal is disposed in the groove; the first bottom edge of the side plate comprises a plurality of bosses which is embedded in the groove and abuts against the seal.

In a class of this embodiment, the annular sleeve is disposed in a middle of the side plate; a junction between an inner surface of the bottom plate and an inner wall of the annular sleeve comprises a first arc surface.

In a class of this embodiment, a junction between the top plate and the side plate comprises a second arc surface; the first arc surface, the inner wall of the side plate, and the second arc surface form a kidney-shaped surface so that the volute body and the cover plate form a flow channel with a smooth outer surface; and a diameter of the flow channel increases from a volute tongue to an air outlet of the volute body.

In a class of this embodiment, the annular sleeve comprises a notch near the exhaust duct; and the notch is in the shape of an arc in an angle of view from an outlet of the exhaust duct to the cavity.

In a class of this embodiment, a guide slope is disposed on the bottom plate behind the notch.

In a class of this embodiment, the annular sleeve comprises a first flat plate and a second flat plate which is shorter than the first flat plate; a junction between the first flat plate and the second flat plate comprises a third arc surface; the notch is disposed through the first flat plate, the second flat plate, and the third arc surface.

The disclosure provides an induced draft fan comprising the volute assembly, a wind wheel, and a motor; the motor is disposed on the top of the volute assembly; a front end of a rotating shaft of the motor is inserted into the volute assembly and is connected to the wind wheel.

In a class of this embodiment, the wind wheel comprises a wheel disk, a plurality of blades, and a shaft mounting base protruding from the middle of the wheel disk; the shaft mounting base comprises a shaft hole; the wheel disk comprises a bottom surface and the plurality of blades is disposed circumferentially at intervals around the shaft mounting base on the bottom surface; an air duct is formed between every two adjacent blades; each of the plurality of blades comprises a first surface and a second surface; the first surface is at least partially inclined relative to the second surface and the bottom surface of the wheel disk.

In a class of this embodiment, the second surface is perpendicular to the wheel disk.

In a class of this embodiment, the first surface comprises a parallel surface and an inclined surface; the parallel surface is parallel to the second surface; the second surface and the inclined surface form a V-shaped configuration; the second surface and the inclined surface intersect at an acute angle a.

In a class of this embodiment, $30° \leq a \leq 45°$.

In a class of this embodiment, $a=35°$.

In a class of this embodiment, start points of inclined surfaces of the plurality of blades are disposed along a first circle, and start points of the plurality of blades are disposed along a second circle; and a diameter of the first circle is greater than that of the second circle.

In a class of this embodiment, each of the plurality of blades comprises a primary blade and a secondary blade; the end portion of the secondary blade is connected to the middle of the primary blade; the primary blade is perpendicular to the wheel disk; the secondary blade is inclined with respect to the wheel disk; the inner surface of the secondary blade is the inclined surface.

In a class of this embodiment, a V-shaped groove is disposed between the primary blade and the secondary blade; the depth of the V-shaped groove increases from the end portion of the secondary blade to the outlet between every two adjacent blades; the width of the V-shaped groove narrows from the end portion of the secondary blade to the outlet between every two adjacent blades.

In a class of this embodiment, an annular plate is disposed on a top of the plurality of blades near the outlet between every two adjacent blades.

In a class of this embodiment, an outer edge of the wheel disk and outer edges of the plurality of blades each comprise an arc segment; the arc segment is bent from the cover plate to the volute body.

In a class of this embodiment, the plurality of blades is unevenly distributed on the end surface of the wheel disk.

The following advantages are associated with the volute assembly and the induced draft fan comprising the same:

1. The cover plate comprises a bottom plate and an annular sleeve surrounding the bottom plate. The annular sleeve comprises a first bottom edge and a flange protruding from the first bottom edge. The flange comprises a plurality of buckles disposed at intervals. The seal is disposed around the annular sleeve and is supported by the flange. The side plate is matched with the annular sleeve in shape. When the cover plate is disposed on the volute body, the annular sleeve is nested in the side plate and the plurality of clamping blocks is secured to the plurality of buckles to fasten the cover plate to the volute body. The seal abuts against the side plate and the flange, thereby achieving a sealing effect. The cover plate is snap-fit into the volute body. The structure of the volute assembly is simple to facilitate maintenance, assembly and disassembly of the volute body, the cover plate, and the induced draft fan. The seal is disposed between the volute body and the cover plate to enhance the leak resistance of the volute assembly.
2. The volute body and the cover plate form a flow channel with a smooth outer surface, which reduces the impact of the airflow on the surface of the volute body, makes the air flow more smoothly, and provides a uniform pressure distribution of airflow in the flow channel. The diameter of the flow channel gradually increases from the volute tongue to the air outlet, so that after the airflow comes out of the wind wheel, the discharge airflow area is gradually increased, which prevents the airflow loss caused by the sudden increase of the cross-sectional area of the air outlet and reduces the surge flow, thereby improving the operating efficiency of the whole machine and reducing noise and vibration in the whole machine.

Figure 1:
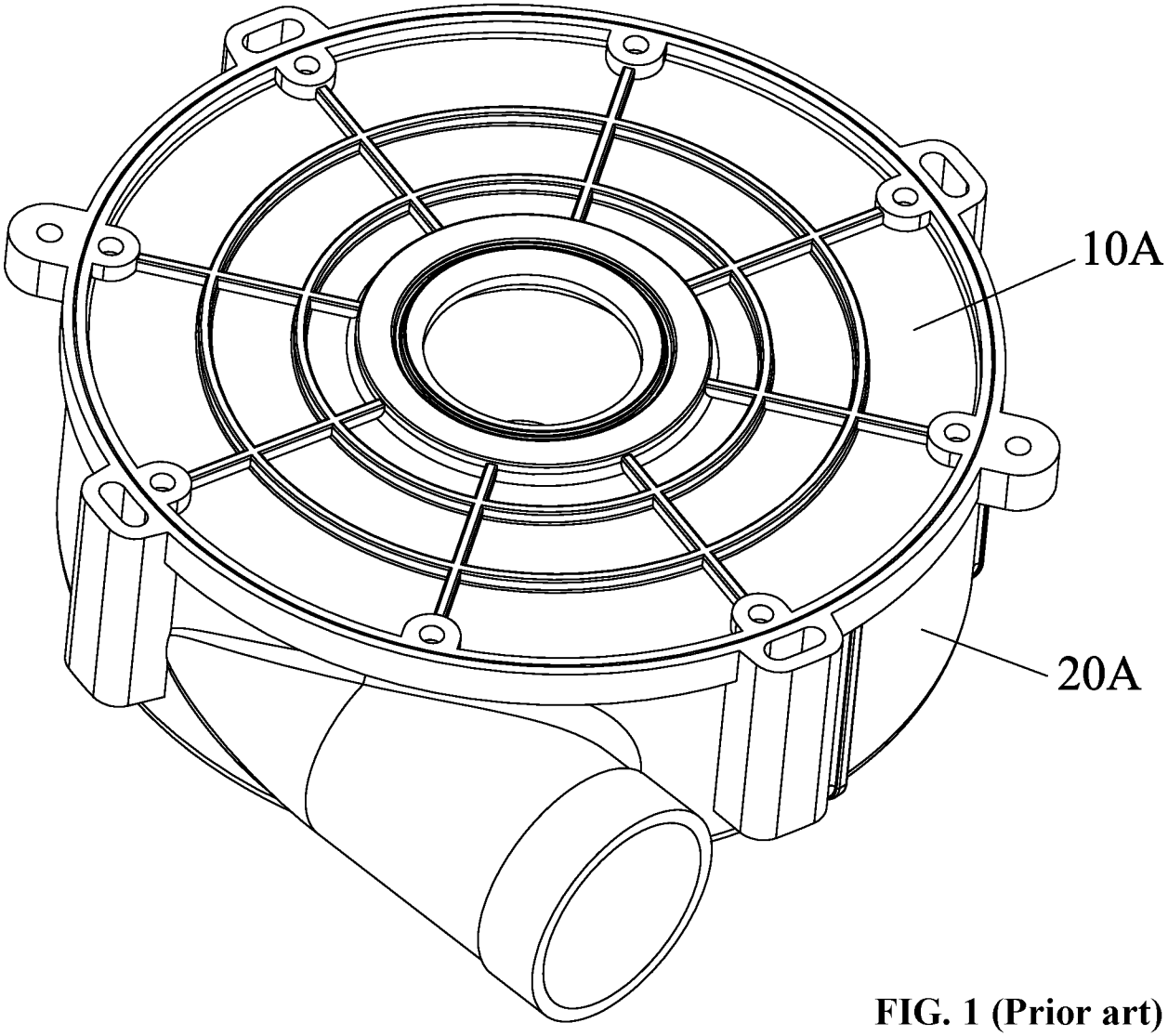
FIG. 1 (Prior art)
FIG. 1 is a perspective view of a volute assembly in the related art.
Figure 2:
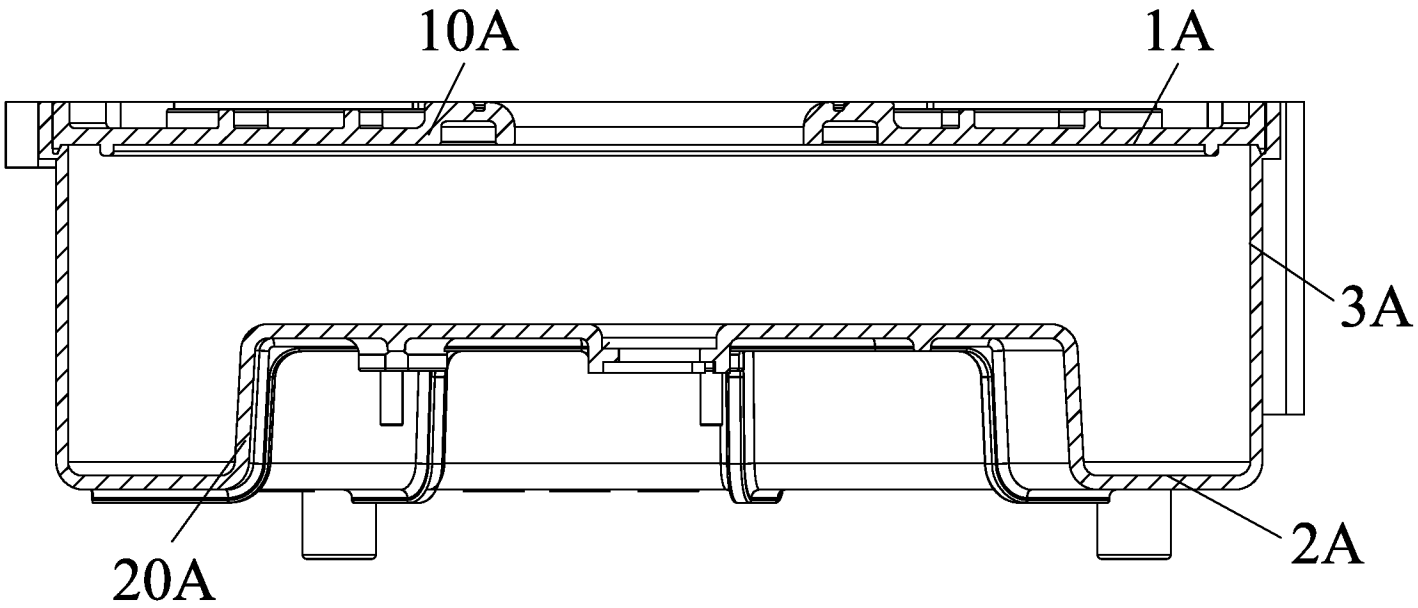
FIG. 2 (Prior art)
FIG. 2 is a schematic diagram of a volute assembly in the related art.
Figure 3:
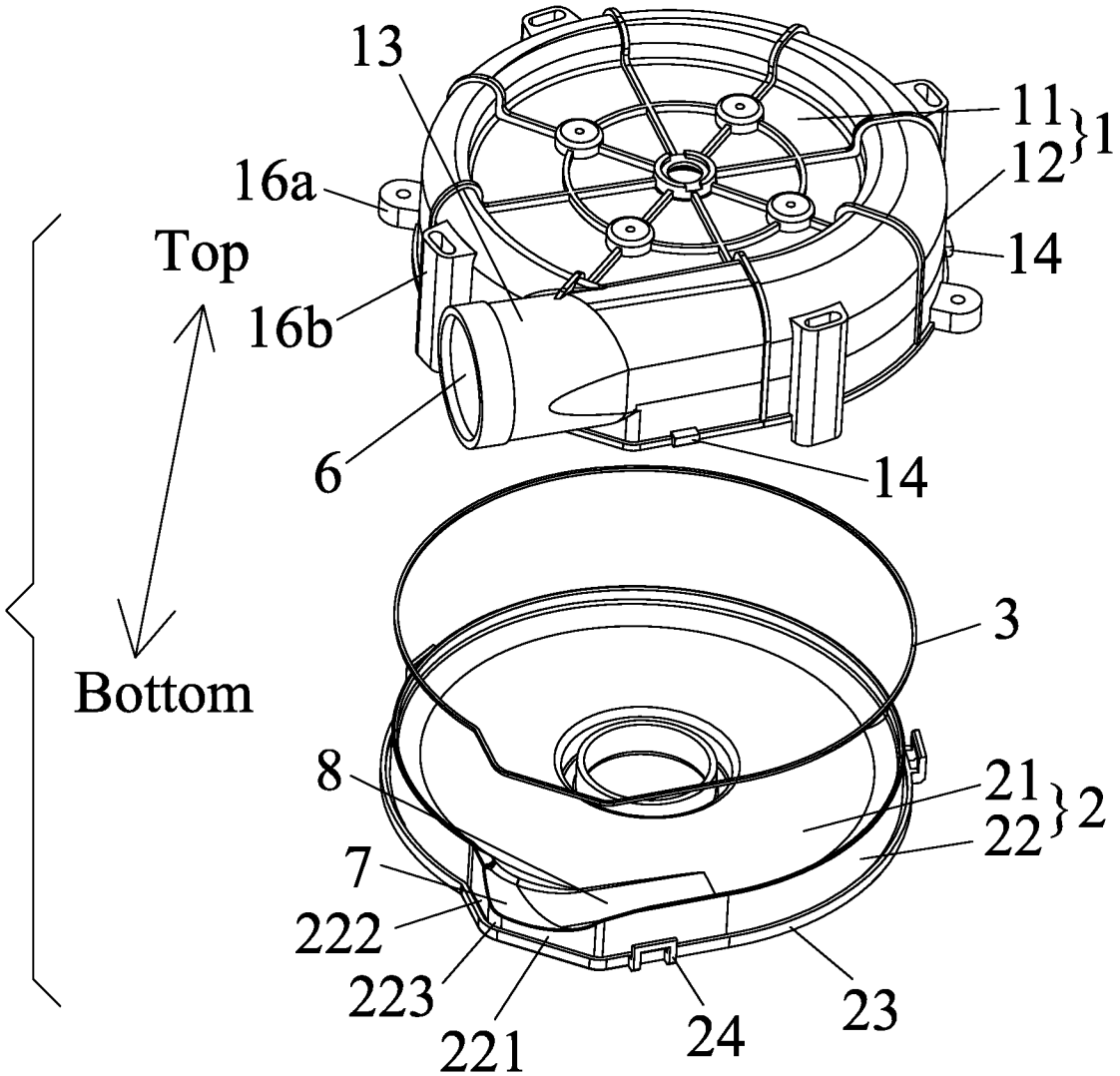
FIG. 3 is an exploded view of a volute assembly according to Example 1 of the disclosure.

In the drawings, the following reference numbers are used: 1. Volute body; 2. Cover plate; 3. Seal; 4. Groove; 5. Volute tongue; 6. Air outlet; 10. Volute assembly; 11. Top plate; 12. Side plate; 13. Exhaust duct; 14. Clamping block; 16*a*. Mounting feet; 16*b*. Mounting feet; 21. Bottom plate; 22. Annular sleeve; 23. Flange; 24. Buckle; 25. Cylinder; 26. Air inlet; 27. Reinforcing rib; 30. Motor; 90. Wind wheel; 91. Wheel disk; 903. Arc segment; 911. Shaft mounting base; 912. Shaft hole; 913. Bottom surface; 92. Blade; 920. V-shaped groove; 921. First surface; 922. Second surface; 923. Primary blade; 924. Secondary blade; 9211. Parallel surface; 9212. Inclined surface; 9240. End portion; 93. Air duct; 94. Annular plate; 100. Cavity; 121. Boss; 210. Inner surface; 220. First arc surface; 221. First flat plate; 222.

Second flat plate; 223. Third arc surface; 231. First flange; 232. Second flange; 10A. Volute body; 20A. Cover plate; 1A. First inner wall surface; 2A. Second inner wall surface; and 3A. Third inner wall surface.

DETAILED DESCRIPTION

To further illustrate, embodiments detailing a volute assembly and an induced draft fan comprising the same are described below. It should be noted that the following embodiments are intended to describe and not to limit the disclosure.

Example 1

Referring to FIGS. 7, 9-15, a volute assembly comprises a volute body 1, a cover plate 2, and a seal 3; the volute body 1 comprises a top plate 11, a side plate 12 protruding axially from an edge of the top plate 11, a cavity 100 formed by the top plate 11 and the side plate 12, and an exhaust duct 13 disposed on the side plate 12 and communicating with the cavity 100. The side plate comprises a first bottom edge and a plurality of clamping blocks 14 disposed at intervals along the first bottom edge. The cover plate 2 comprises a bottom plate 21 and an annular sleeve 22 surrounding the bottom plate 21. The annular sleeve 22 comprises a second bottom edge and a flange 23 protruding from the second bottom edge. The flange 23 comprises a plurality of buckles 24 disposed at intervals. The seal 3 is disposed around the annular sleeve 22 and is supported by the flange 23. When the cover plate 2 is disposed on the volute body 1, the annular sleeve 22 is nested in the side plate 12 and the plurality of clamping blocks is secured to the plurality of buckles 24 to fasten the cover plate 5 to the volute body 1. The seal 3 abuts against the side plate 12 and the flange 23, thereby achieving a sealing effect. The cover plate 2 is snap-fit into the volute body 1. The structure of the volute assembly is simple to facilitate maintenance, assembly and disassembly of the volute body 1, the cover plate 2, and the induced draft fan. The seal 3 is disposed between the volute body 1 and the cover plate 2 to enhance the leak resistance of the volute assembly.

The flange 23 comprises a first flange 231 protruding radially outward and a second flange 232 protruding from the edge of the first flange 231. The first flange 231, the second flange 232, and the outer wall of the annular sleeve 22 form a groove 4. The seal 3 is disposed in the groove 4. The first bottom edge of the side plate 12 comprises a boss 121 which is embedded in the groove 4 and abuts against the seal 3, which prevents misplaced installation of the seal ring 3, improving the seal performance of the induced draft fan. The boss 121 is used in conjunction with the groove 4 to enhance the leak resistance of the volute assembly and facilitate installation of the seal 3.

The annular sleeve 22 is nested in the side plate 12, and a depth L of the annular sleeve 22 into the side plate 12 is within a range of 16.6-26.6 mm. The annular sleeve 22 is used in conjunction with the seal 3 to enhance the leak resistance of the volute assembly and allow convenient installation of the volute body 1 and the cover plate 2.

The bottom plate 21 is disposed in the middle of the annular sleeve 22. A junction between an inner surface 210 of the bottom plate 21 and an inner wall of the annular sleeve 22 comprises a first arc surface 220. A junction between the top plate 11 and the side plate 12 comprises a second arc surface 15. The first arc surface 220, the inner wall of the side plate 12, and the second arc surface 15 form a kidney-shaped surface so that the volute body 1 and the cover plate 2 form a flow channel with a smooth outer surface, which reduces the impact of the airflow on the surface of the volute body, makes the air flow more smoothly, and provides a uniform pressure distribution of airflow in the flow channel. A cylinder 25 is disposed on the outer surface of the bottom plate 21 and the cylinder comprises a rim protruding toward the annular sleeve 22. The cylinder 25 comprises a through hole communicating with the bottom plate to serve as an air inlet 26 of the volute assembly. The outer surface of the wall of the cylinder 25 is connected to the annular sleeve 22 through a plurality of reinforcing ribs 27, which enhances the strength of the cover plate 2.

Figure 10:
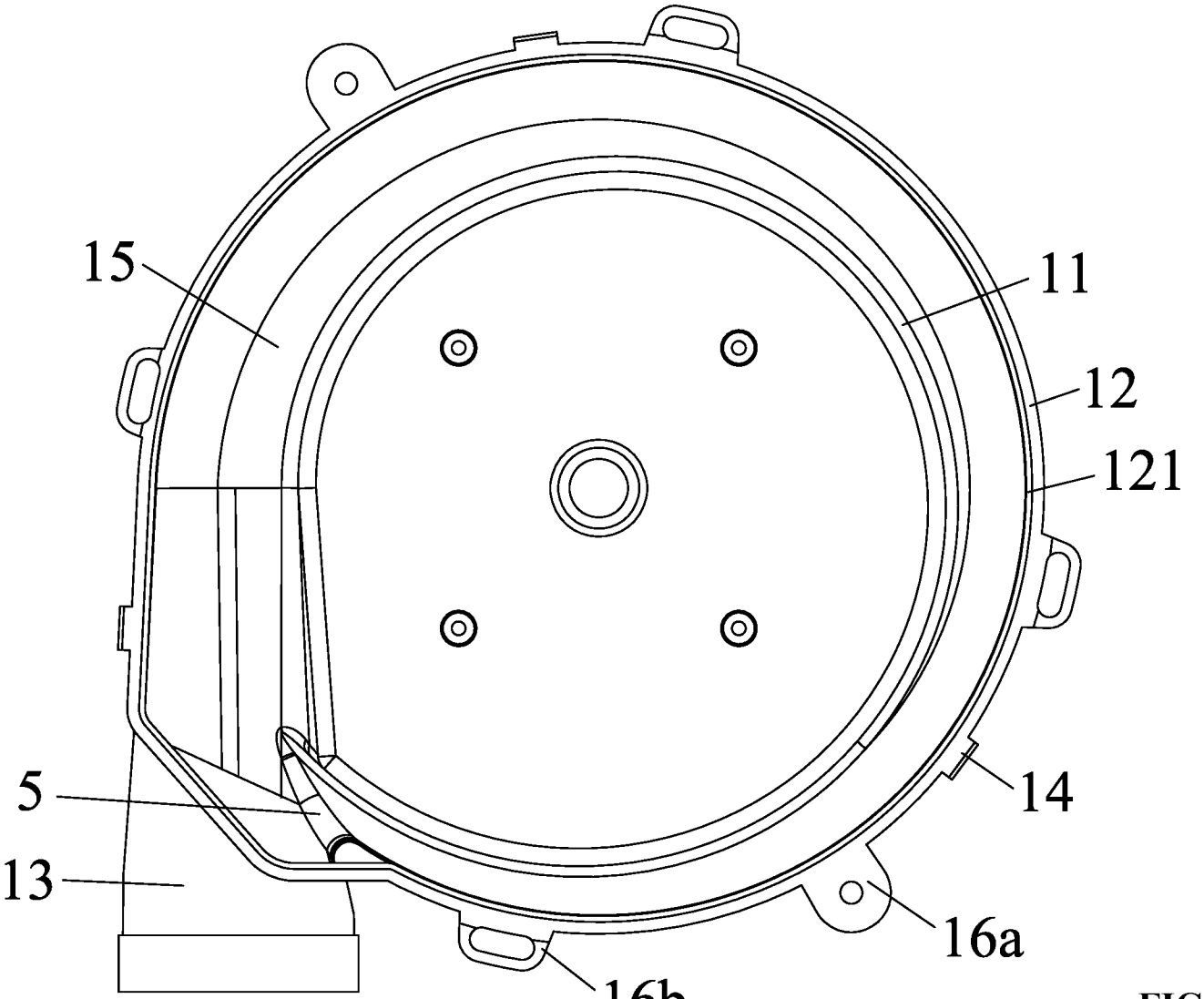
FIG. 10 is a top view of a volute body according to Example 1 of the disclosure.
Figure 11:
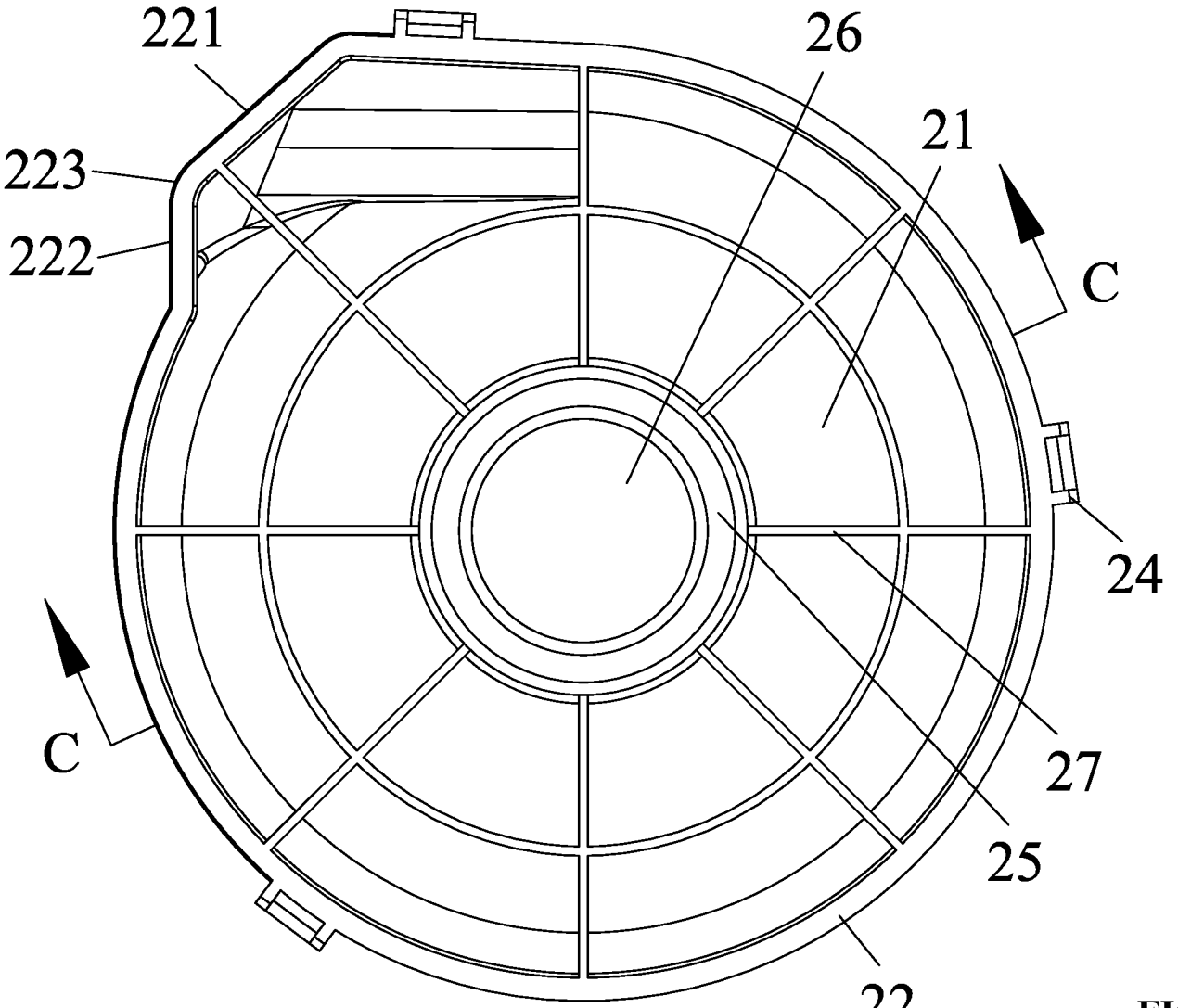
FIG. 11 is a front view of a cover plate according to Example 1 of the disclosure.
Figure 12:
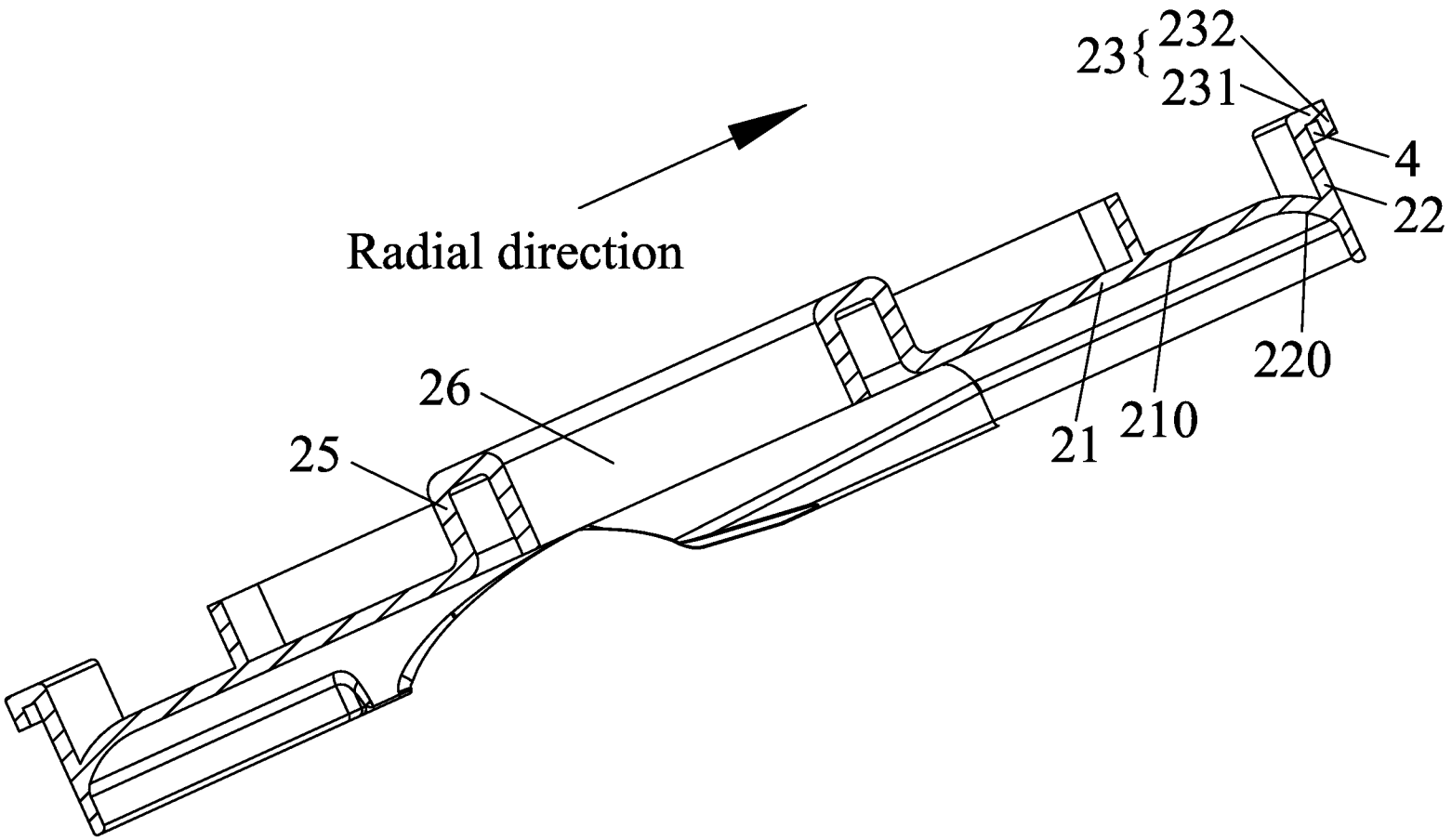
FIG. 12 is a cross-sectional view taken along a line C-C of FIG. 11.

Referring to FIG. 10, the cavity 100 comprises a volute tongue 5 near the exhaust duct 13, and the tail end of the exhaust duct 13 serves as an air outlet 6 of the volute body. A diameter of the flow channel gradually increases from the volute tongue 5 to the air outlet 6, so that after the airflow comes out of the wind wheel 90, the discharge airflow area is gradually increased, which prevents the airflow loss caused by the sudden increase of the cross-sectional area of the air outlet and reduces the surge flow, thereby improving the operating efficiency of the whole machine and reducing noise and vibration in the whole machine.

Figure 4:
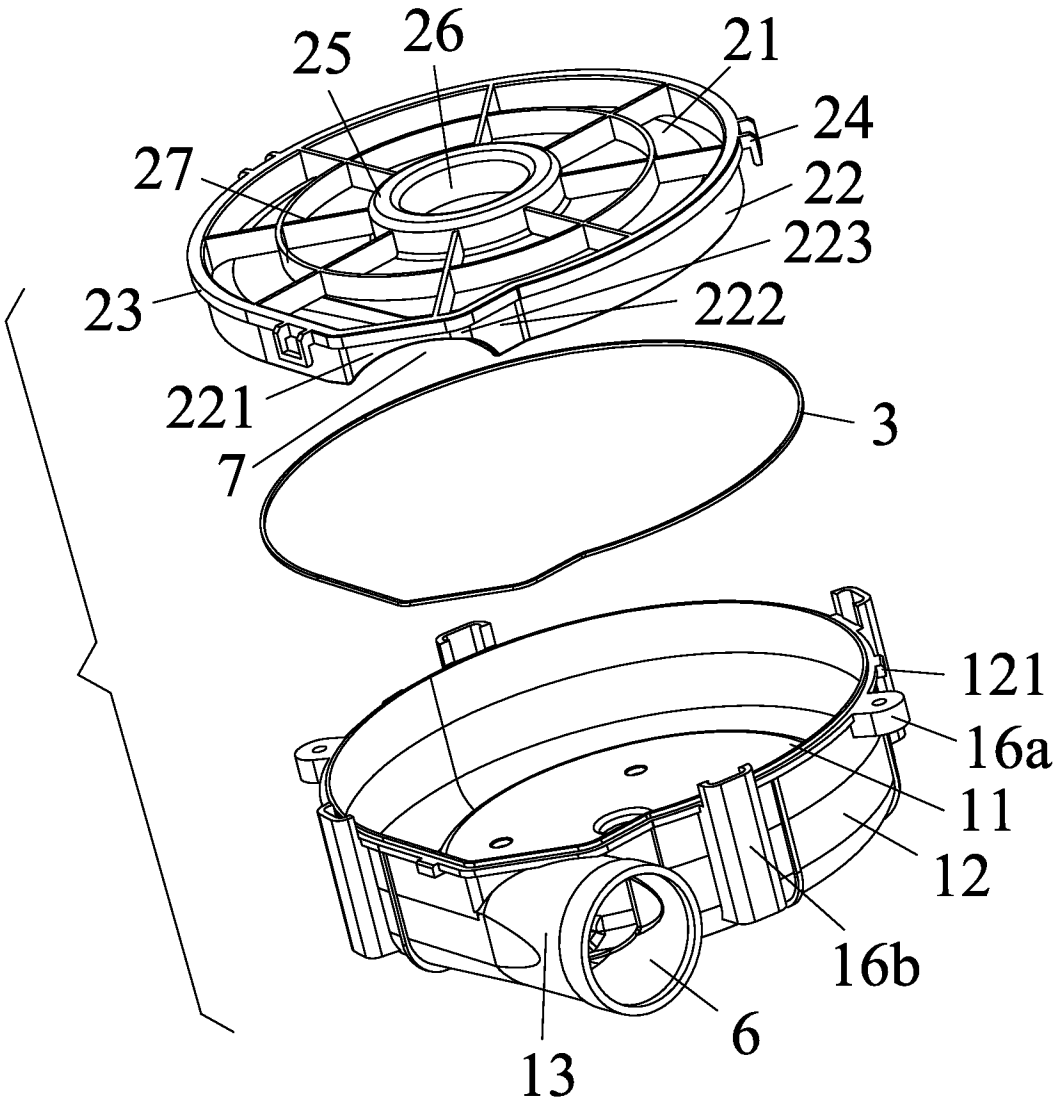
FIG. 4 is another exploded view of a volute assembly according to Example 1 of the disclosure.
Figure 5:
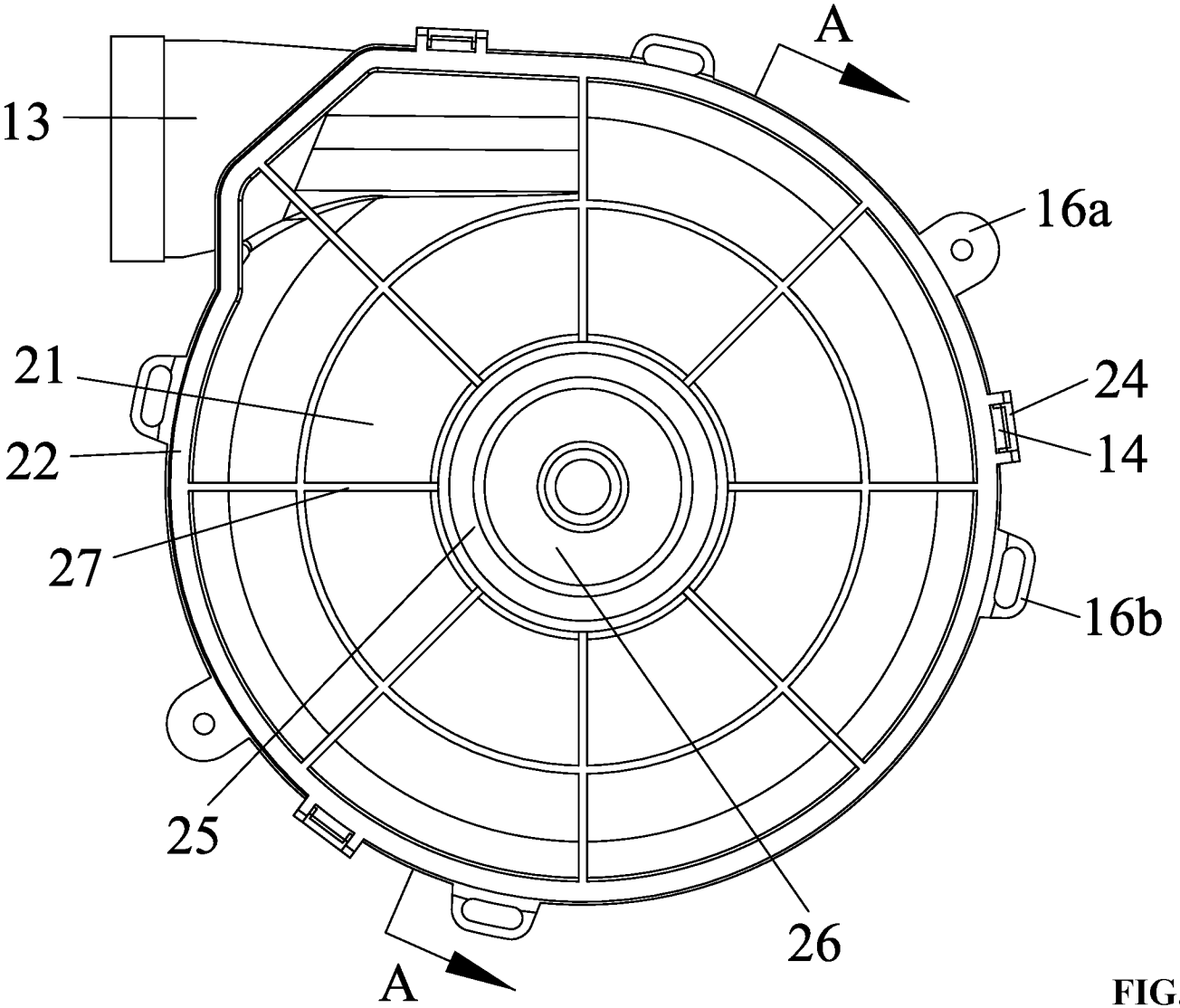
FIG. 5 is a top view of a volute assembly according to Example 1 of the disclosure.
Figure 6:
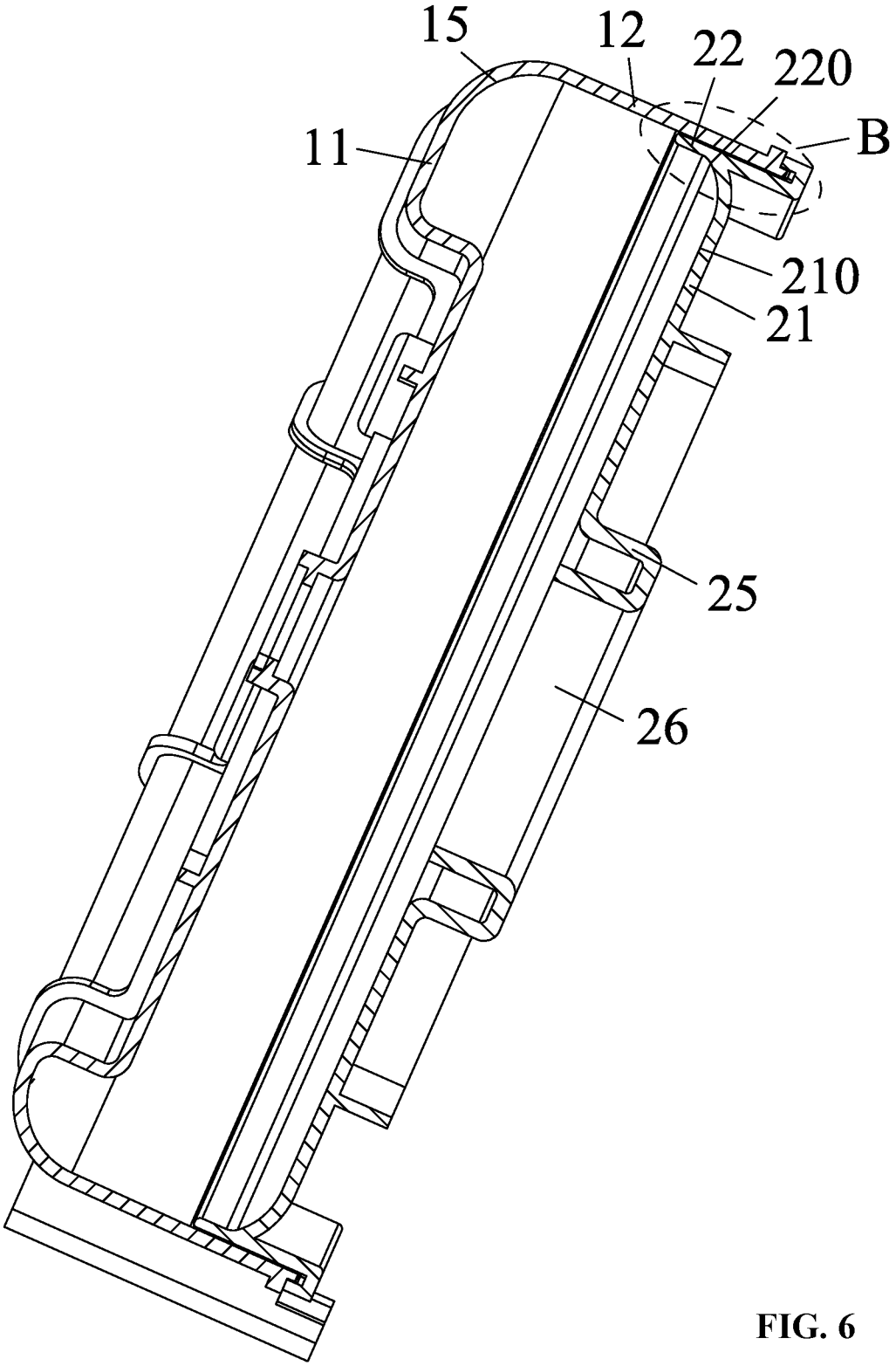
FIG. 6 is a cross-sectional view taken along a line A-A of FIG. 5.
Figure 7:
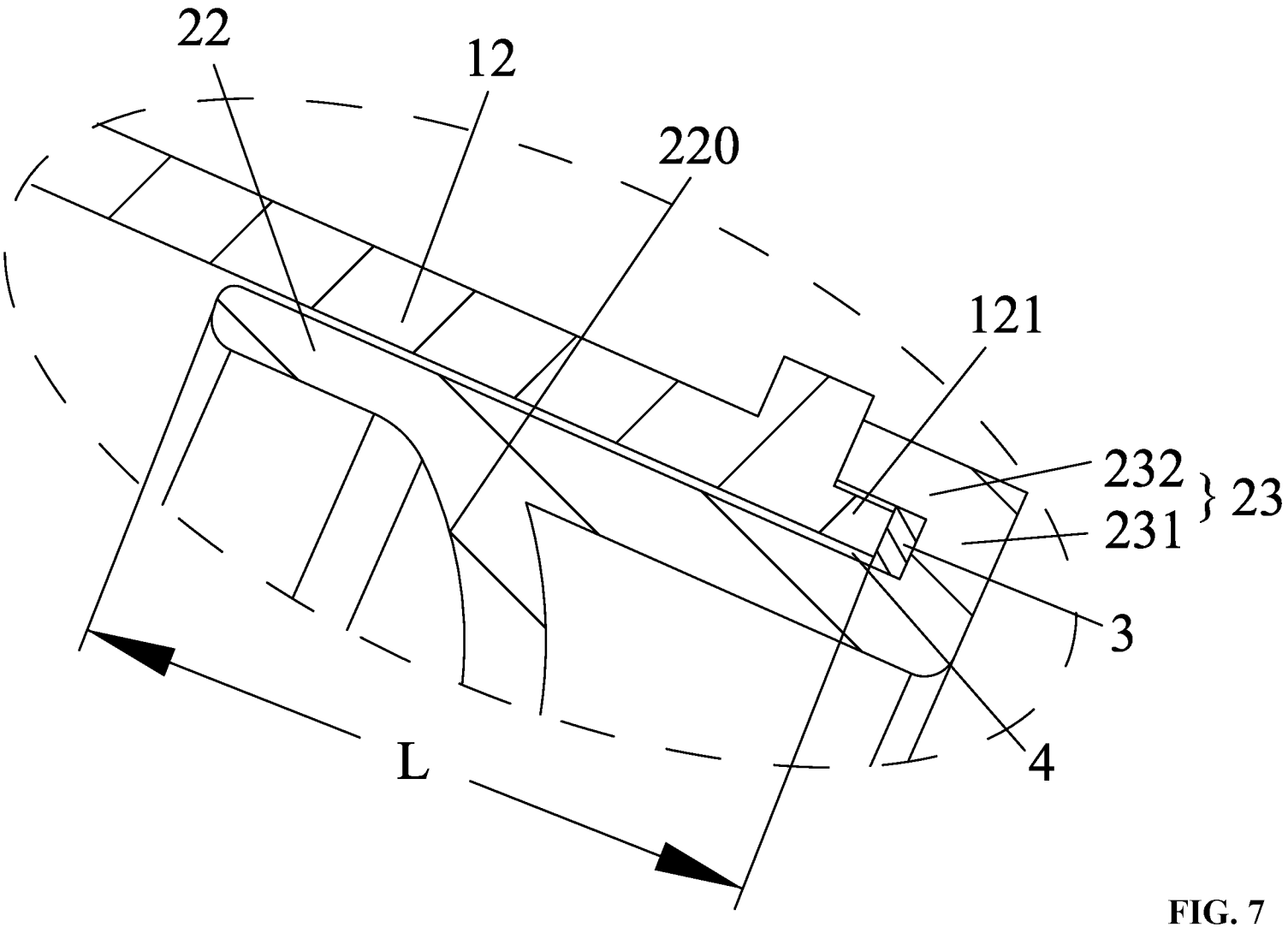
FIG. 7 is an enlarged schematic diagram of part B of FIG. 6.
Figure 8:
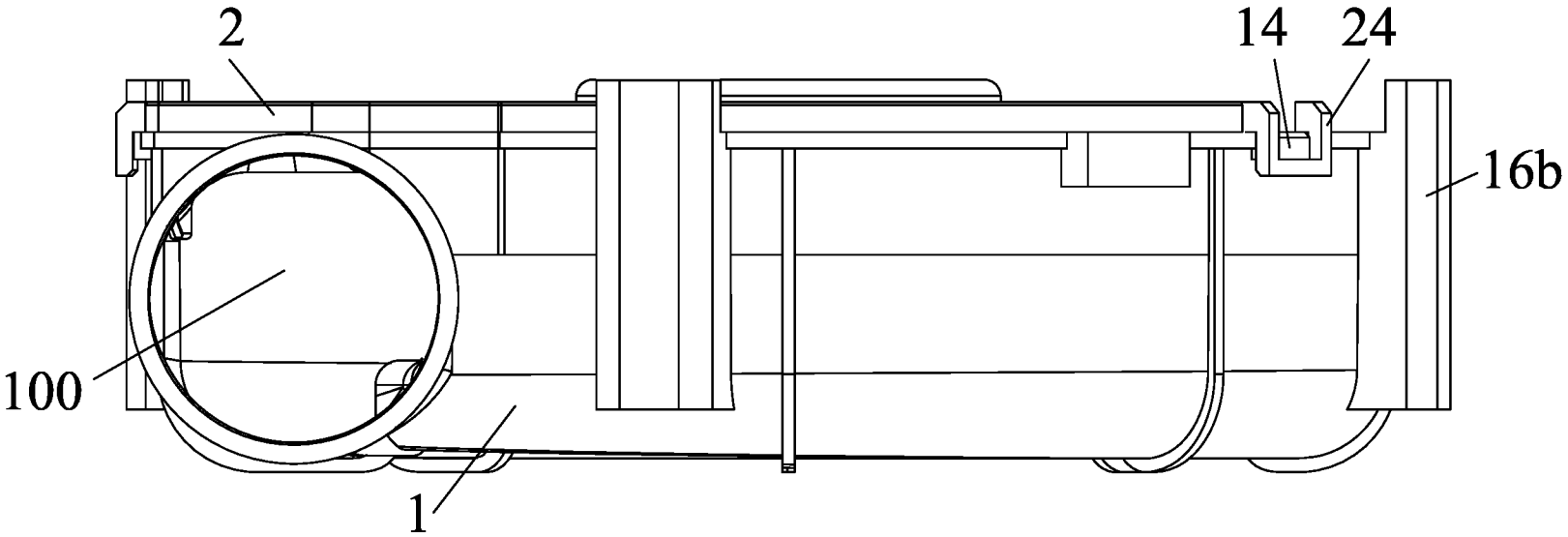
FIG. 8 is a front view of a volute assembly according to Example 1 of the disclosure.
Figure 9:
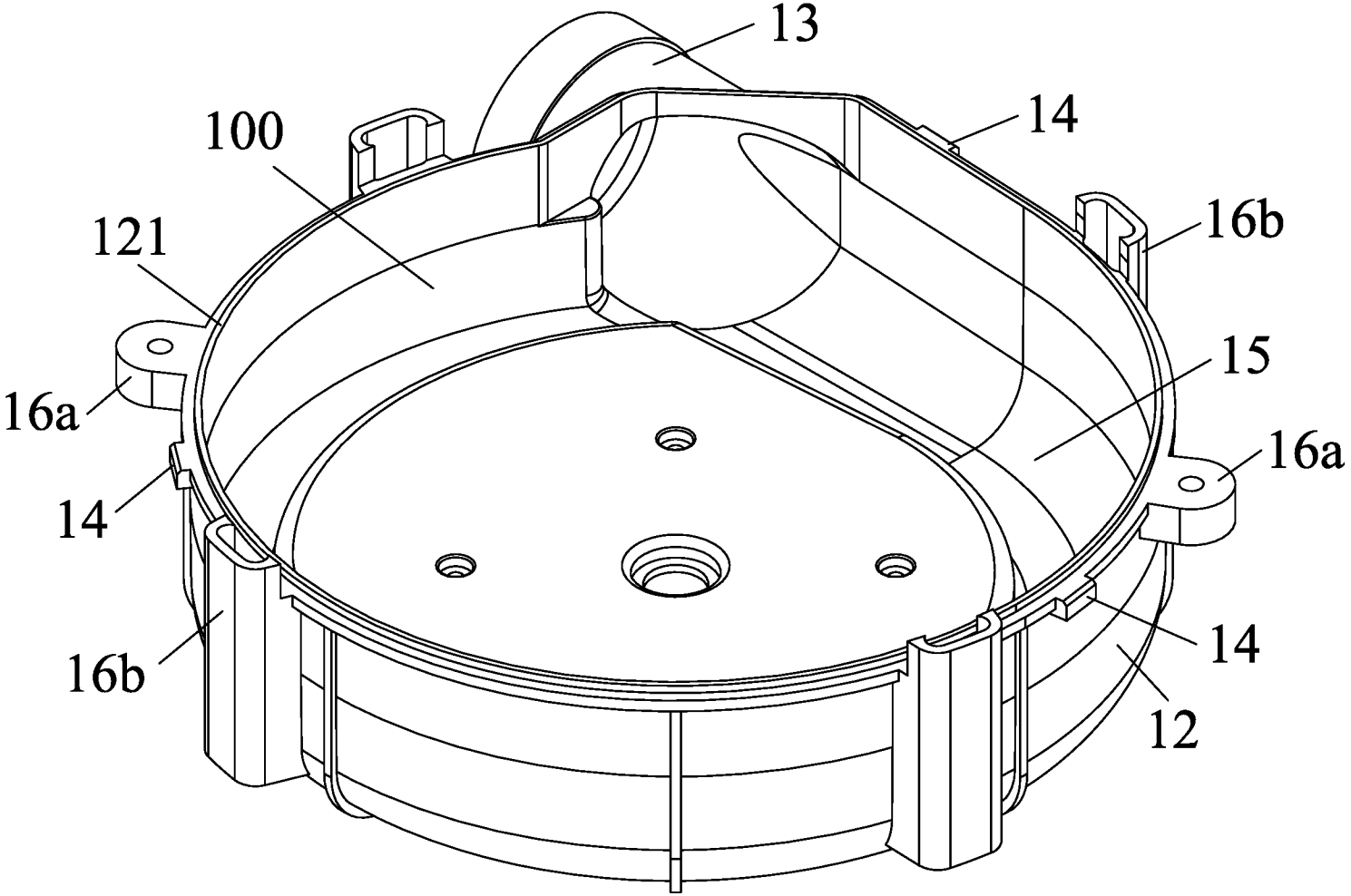
FIG. 9 is a perspective view of a volute body according to Example 1 of the disclosure.
Figure 13:
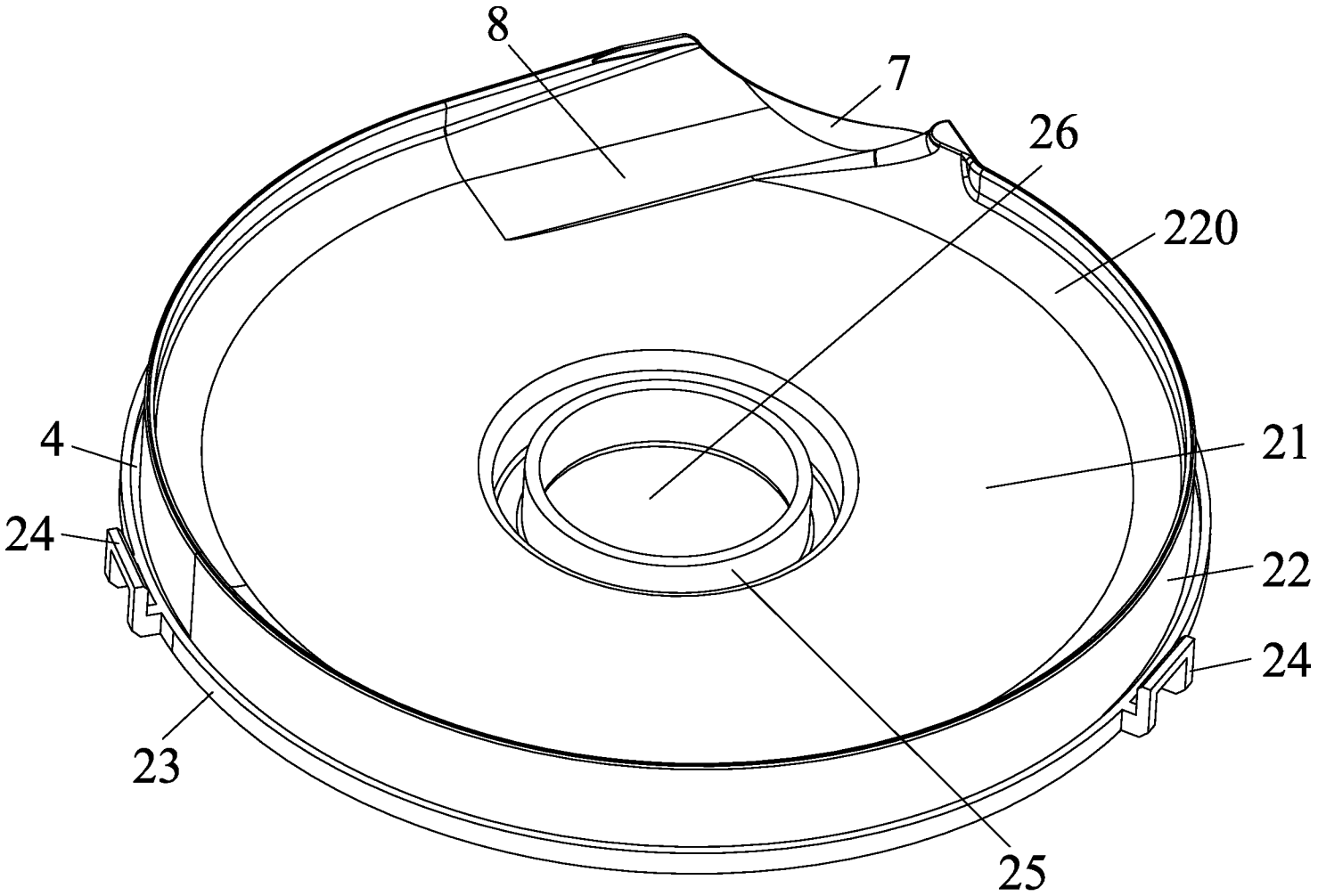
FIG. 13 is a perspective view of a cover plate according to Example 1 of the disclosure.
Figure 14:
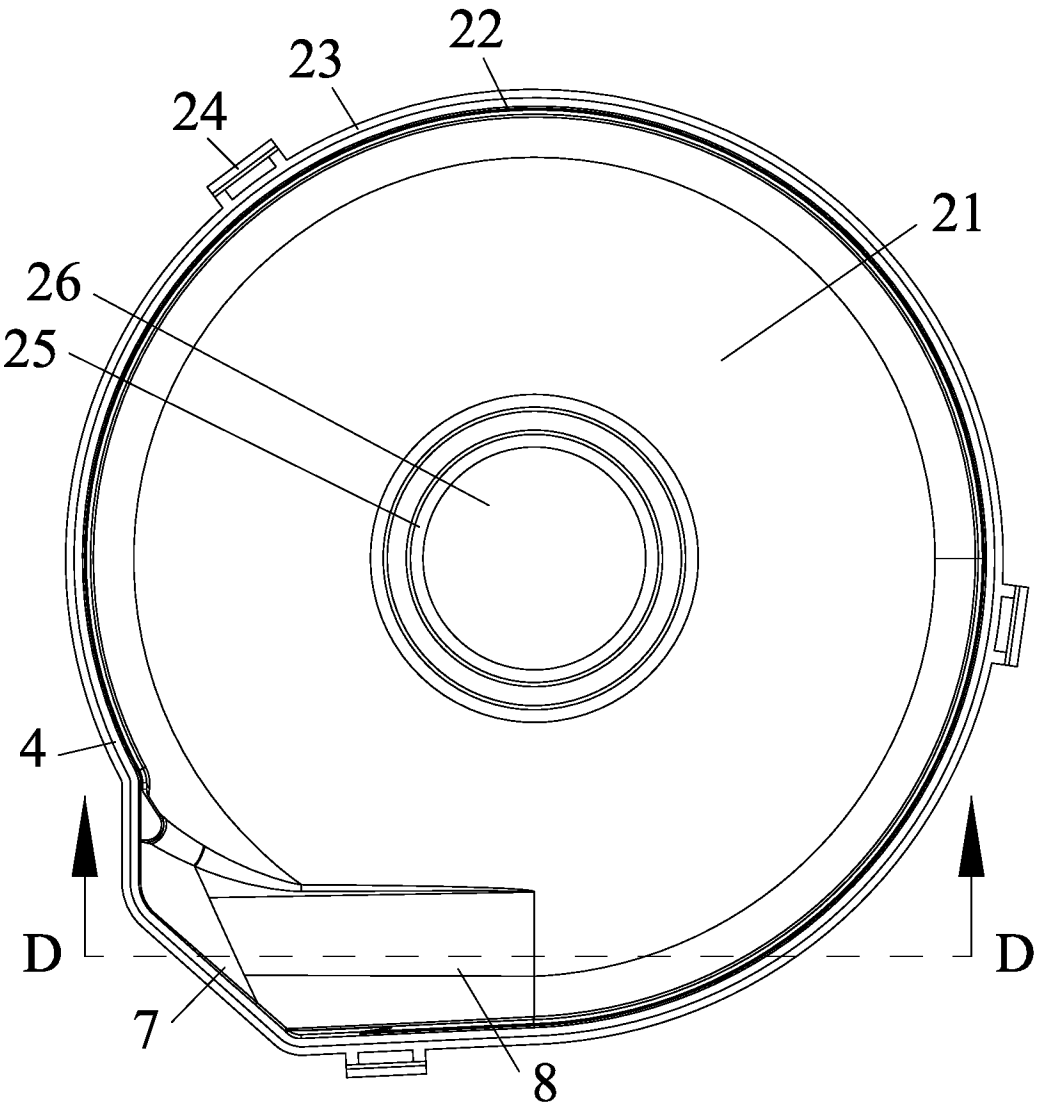
FIG. 14 is a back view of a cover plate according to Example 1 of the disclosure.
Figure 15:
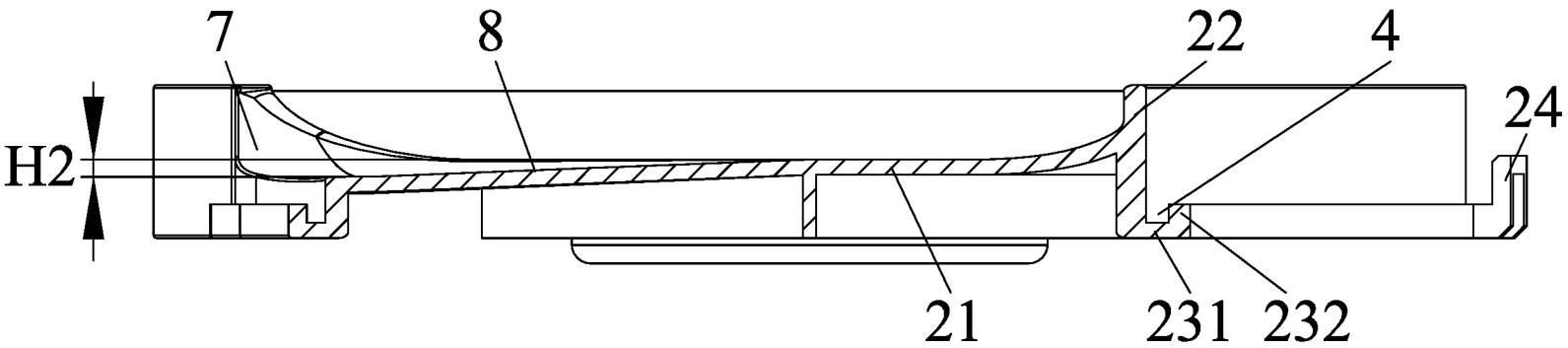
FIG. 15 is a cross-sectional view taken along a line D-D of FIG. 14.
Figure 16:
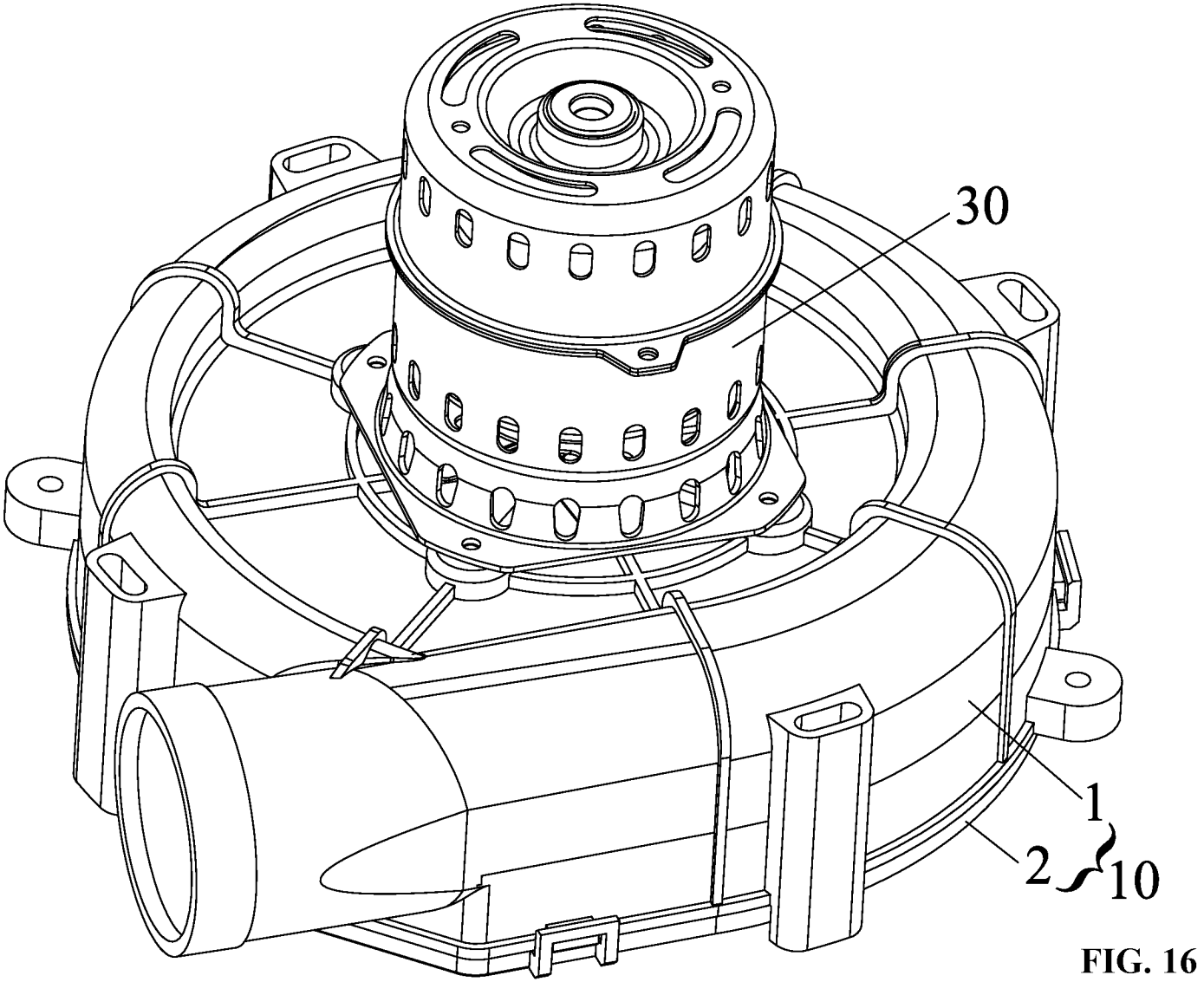
FIG. 16 is a perspective view of an induced draft fan according to Example 2 of the disclosure.
Figure 17:
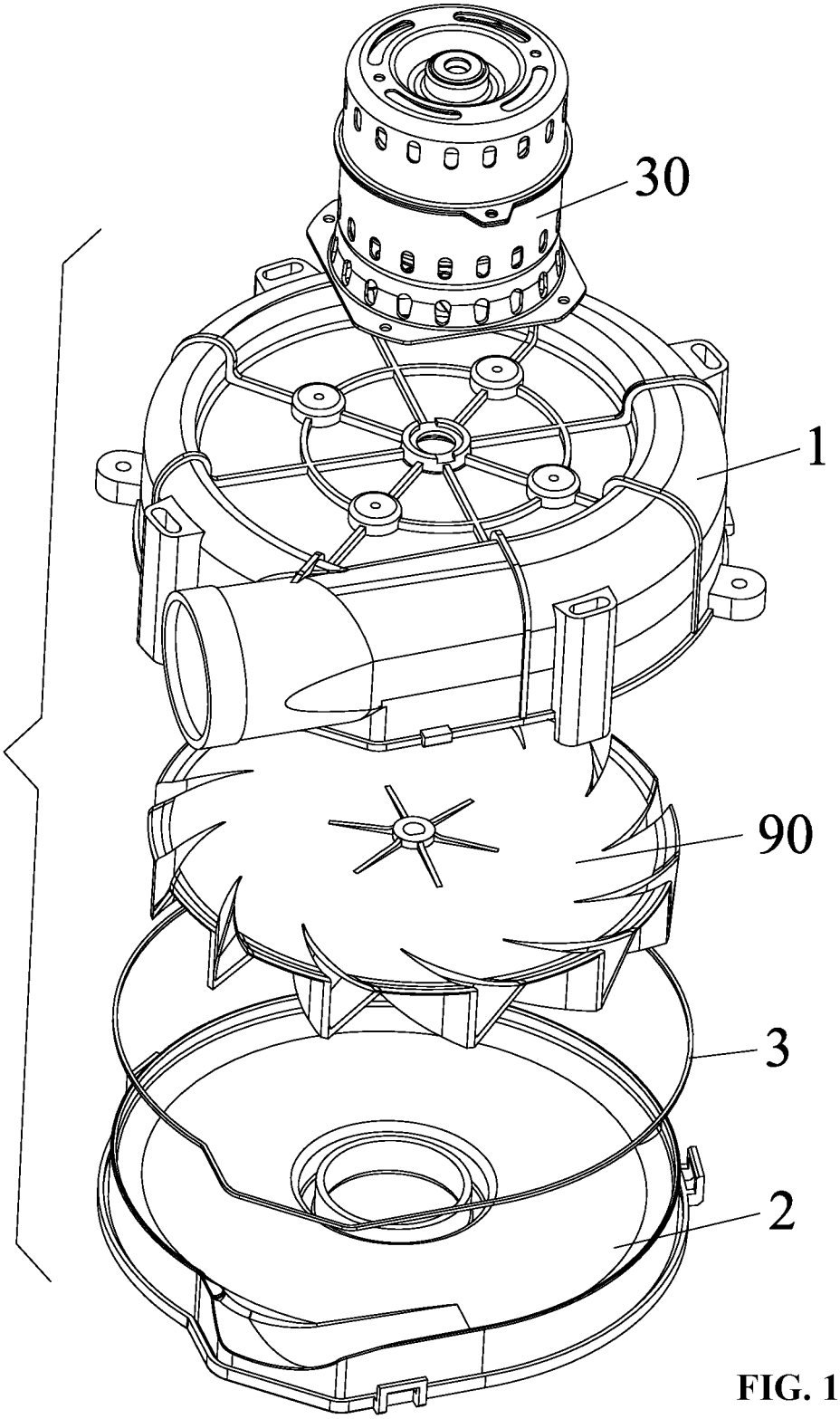
FIG. 17 is an exploded view of an induced draft fan according to Example 2 of the disclosure.
Figure 18:
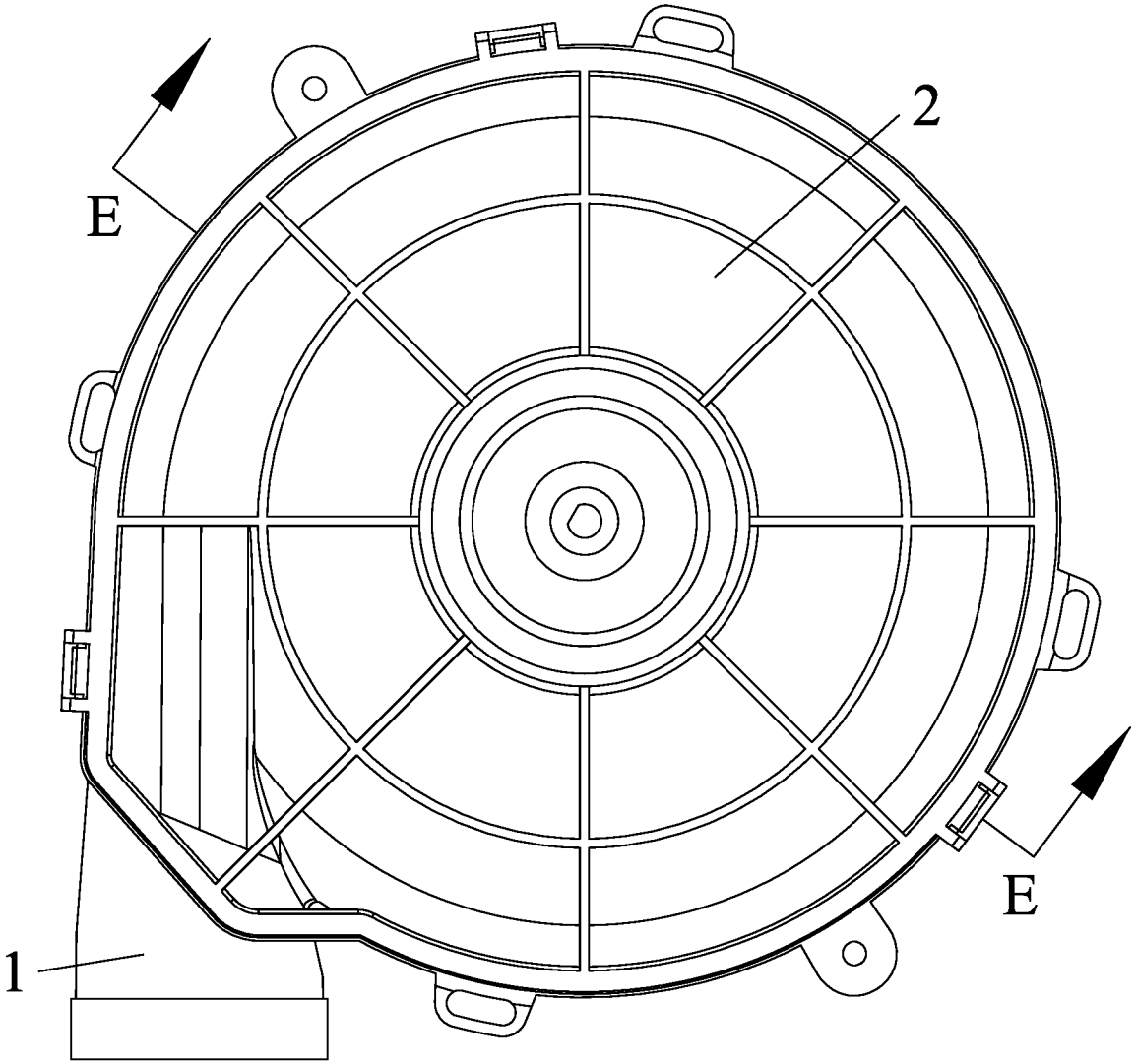
FIG. 18 is a front view of an induced draft fan according to Example 2 of the disclosure.
Figure 19:
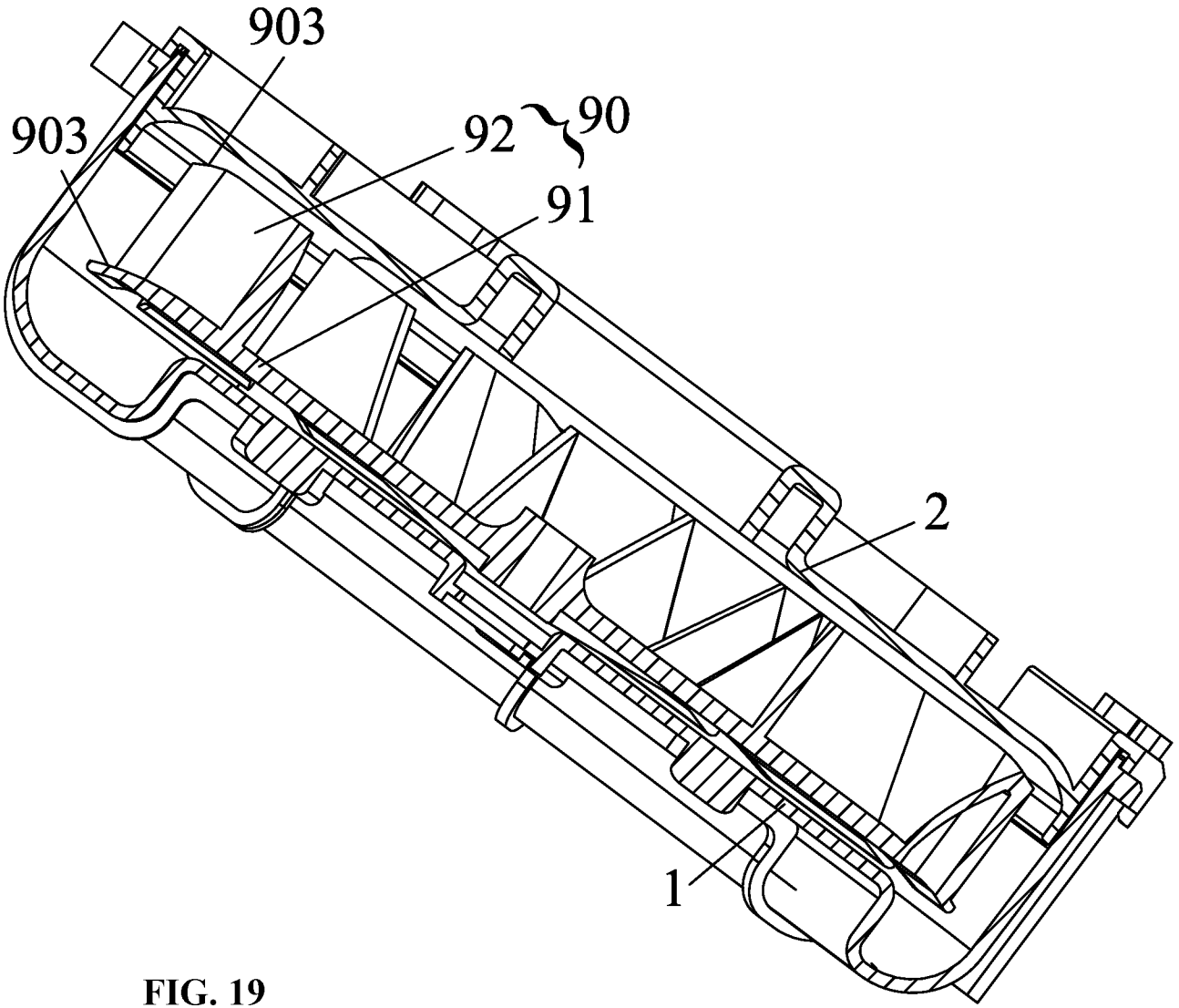
FIG. 19 is a cross-sectional view taken along a line E-E of FIG. 18.
Figure 20:
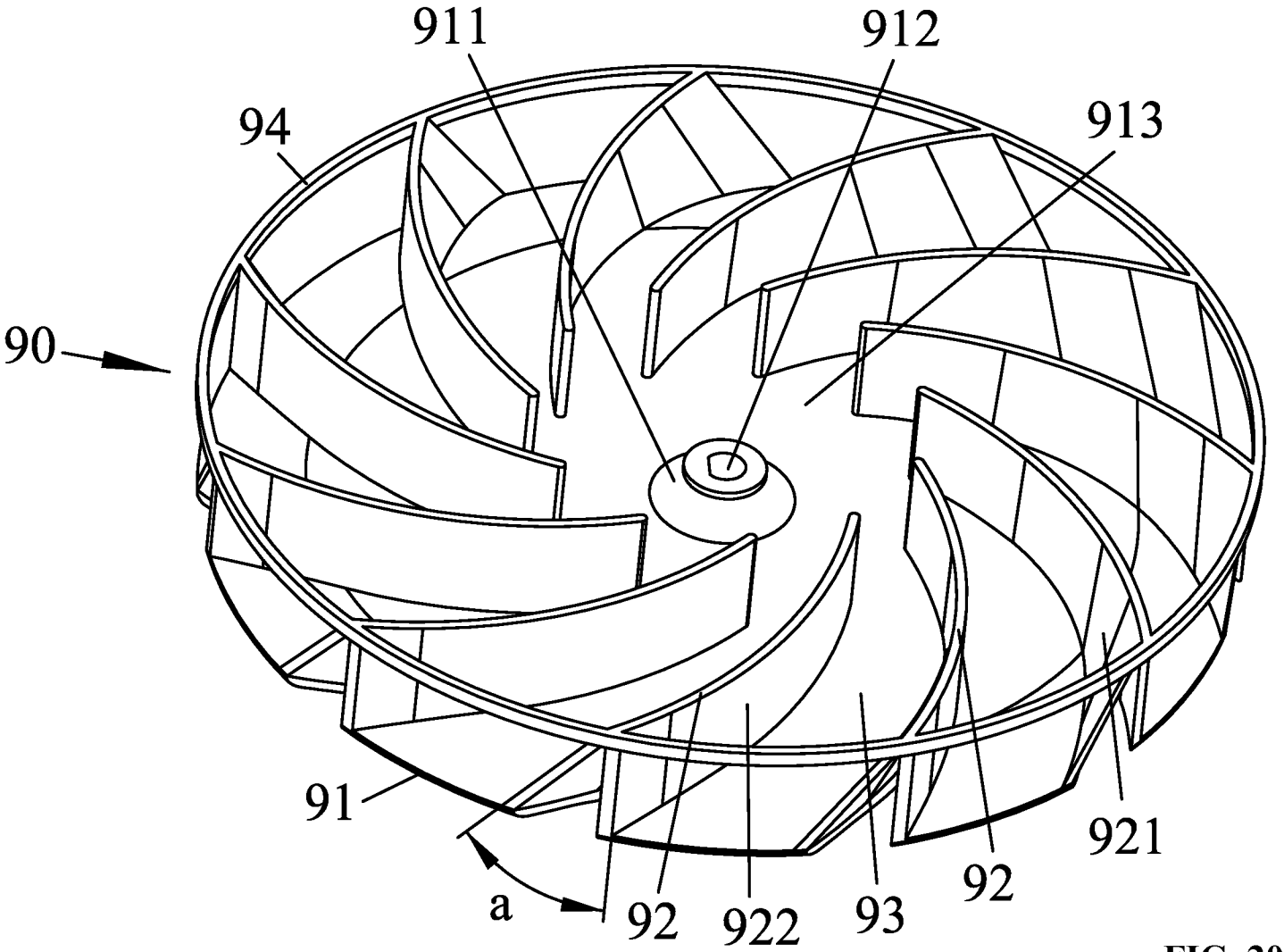
FIG. 20 is a perspective view of a wind wheel according to Example 2 of the disclosure.
Figure 21:
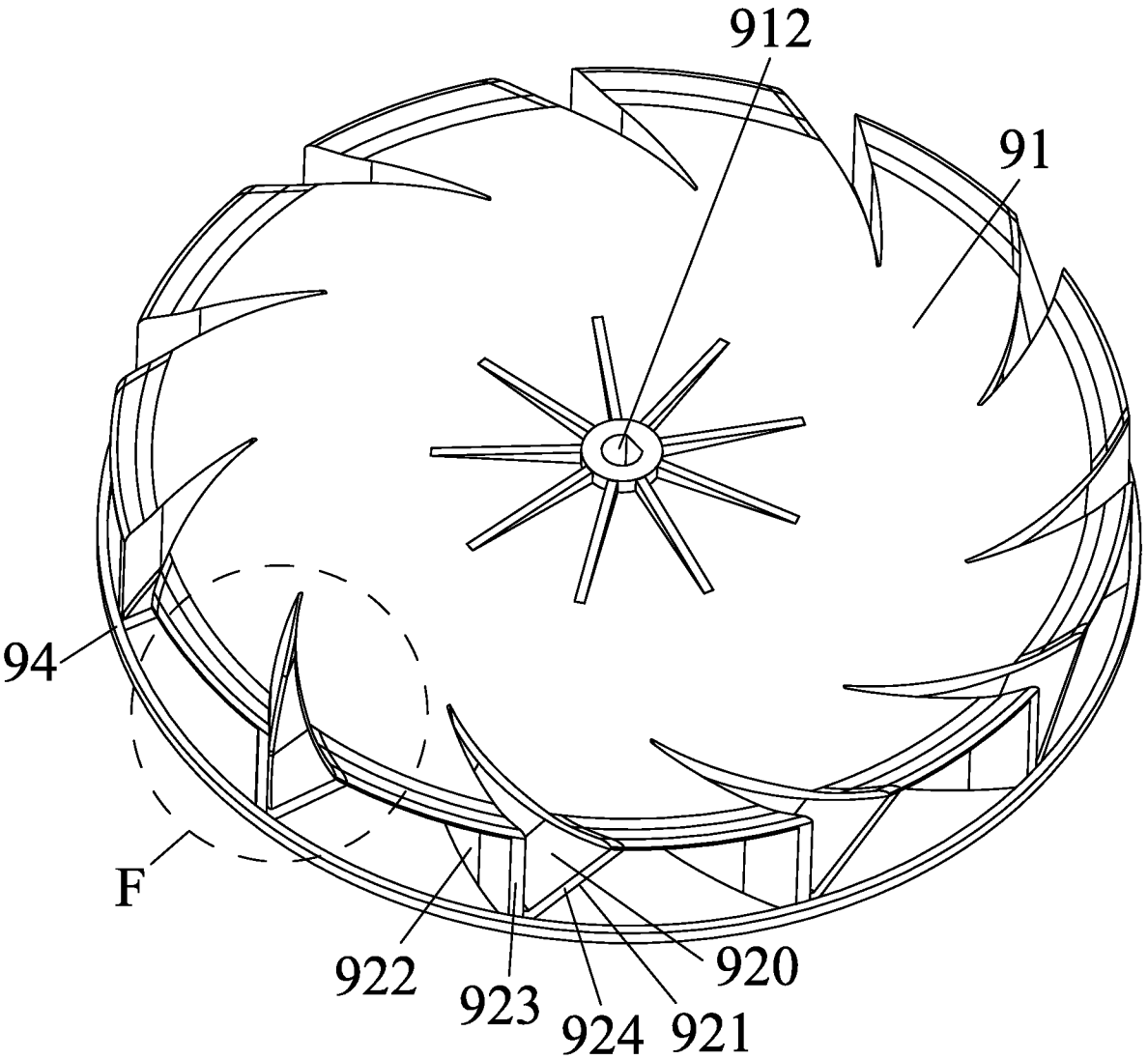
FIG. 21 is another perspective view of a wind wheel according to Example 2 of the disclosure.
Figure 22:
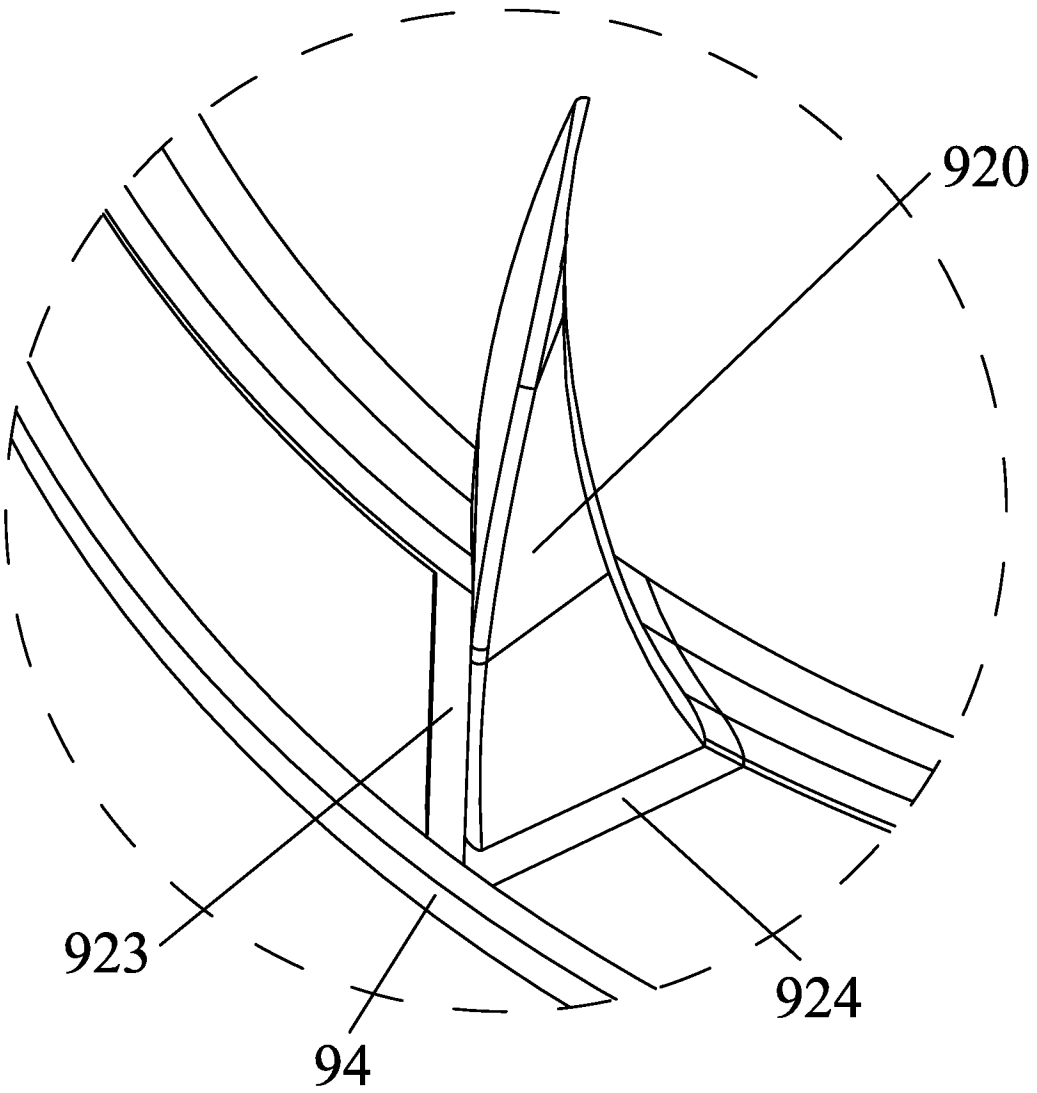
FIG. 22 is an enlarged schematic diagram of part F of FIG. 21.
Figure 23:
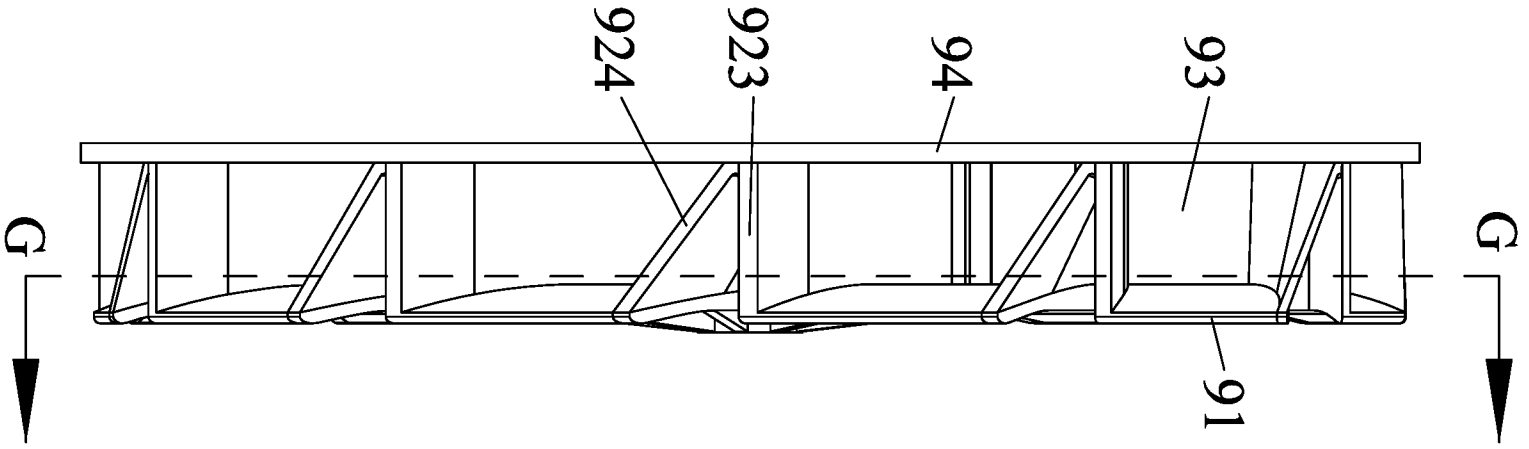
FIG. 23 is a side view of a wind wheel according to Example 2 of the disclosure.
Figure 24:
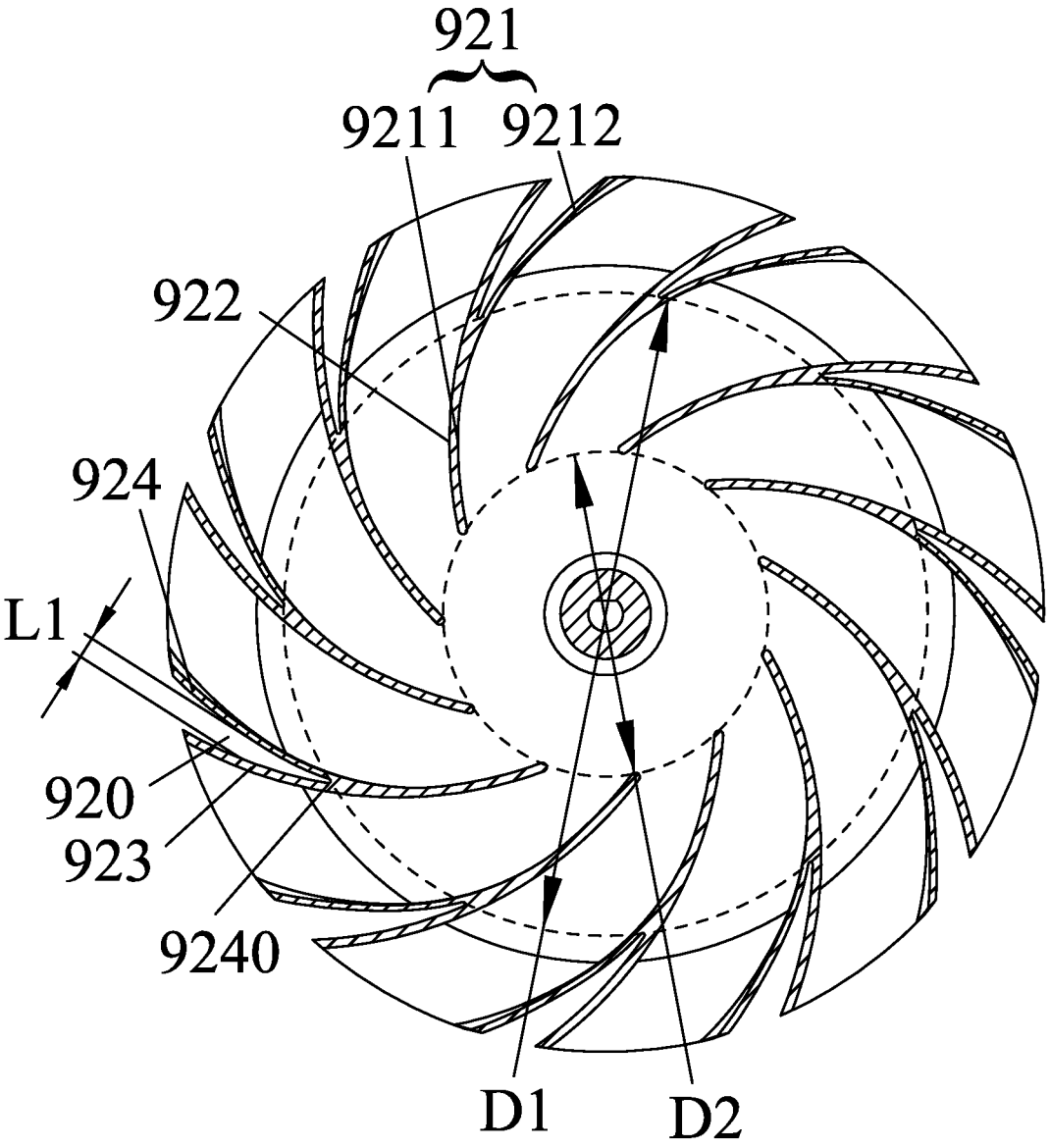
FIG. 24 is a cross-sectional view taken along a line G-G of FIG. 9.
Figure 25:
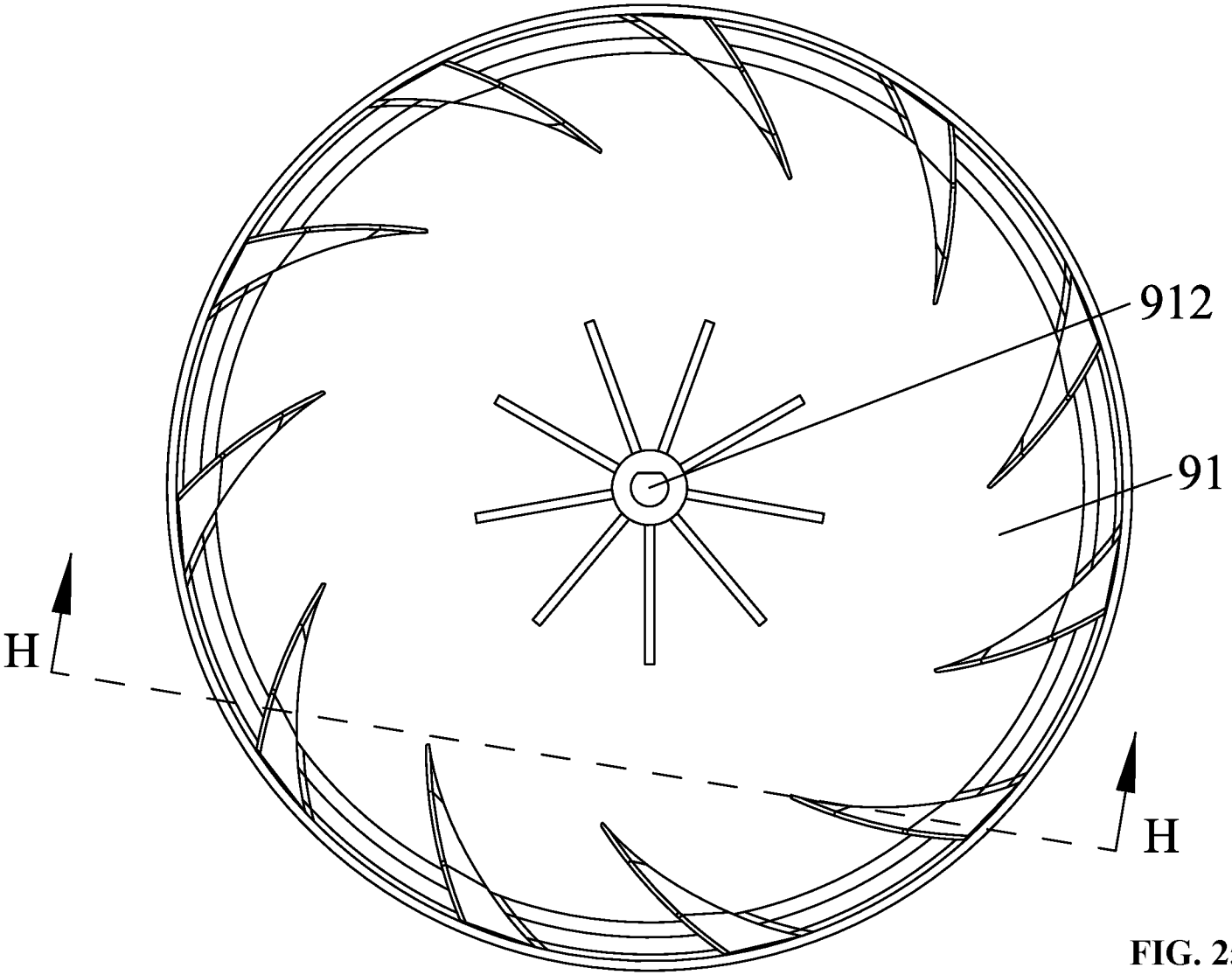
FIG. 25 is a front view of a wind wheel according to Example 2 of the disclosure.
Figure 26:
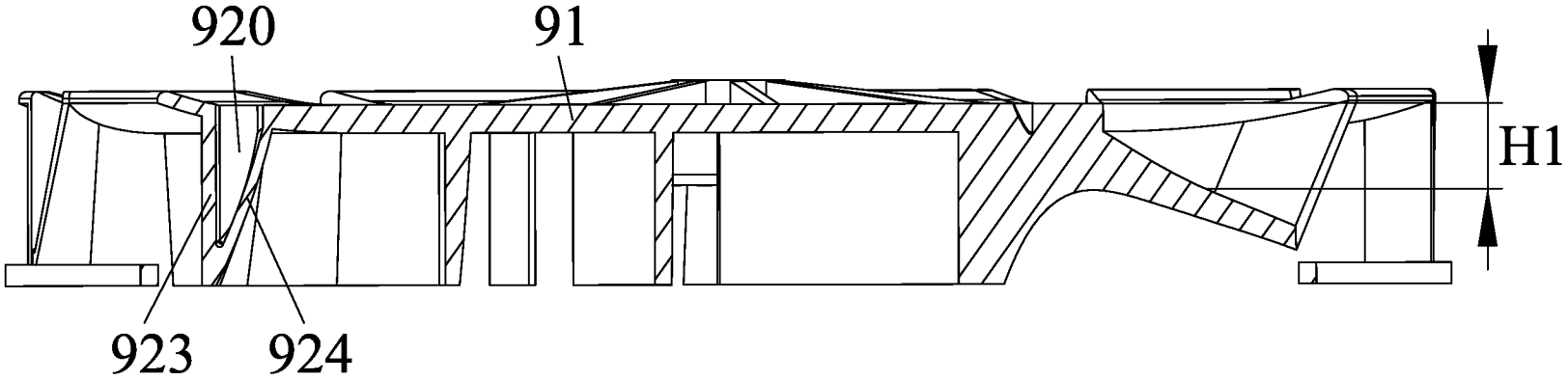
FIG. 26 is a cross-sectional view taken along a line H-H of FIG. 25.
Figure 27:
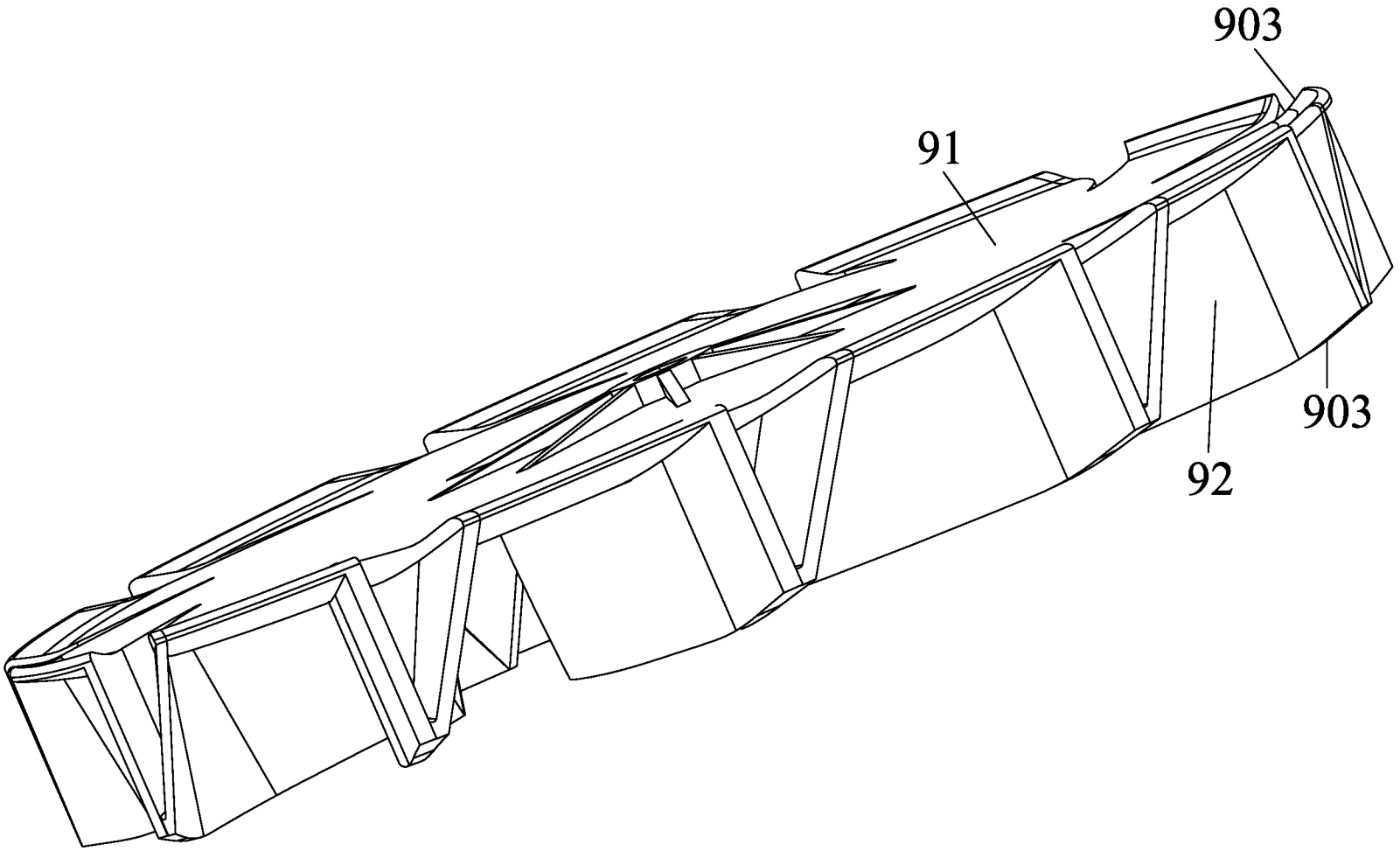
FIG. 27 is a schematic diagram of a wind wheel according to Example 2 of the disclosure.

Referring to FIGS. 4 and 8, the annular sleeve 22 comprises a notch 7 near the exhaust duct 13. The notch 7 is in the shape of an arc in an angle of view from the outlet of the exhaust duct 13 to the cavity 100, permitting a smooth transition between the flow channel and the exhaust duct 13. Referring to FIGS. 13-15, a guide slope 8 is disposed on the bottom plate 21 behind the notch 7 and extends from the inside of the annular sleeve 22 to the exhaust duct 13. A height H2 of the guide slope 8 gradually increases, and then the cross-sectional area of the air outlet 6 gradually increases. After the airflow comes out of the wind wheel 20, the discharge airflow area is gradually increased, which prevents the airflow loss caused by the sudden increase of the cross-sectional area of the air outlet and reduces the surge flow, thereby improving the operating efficiency of the whole machine and reducing noise and vibration in the whole machine.

The annular sleeve 22 comprises a first flat plate 221 and a second flat plate 222 which is shorter than the first flat plate 221; a junction between the first flat plate 221 and the second flat plate 222 comprises a third arc surface 223. The notch 7 is disposed through the first flat plate 221, the second flat plate 222, and the third arc surface 223, which allows convenient installation of the annular sleeve 22 and the side plate 12.

The volute body 1 further comprises a side surface and a plurality of mounting feed 16*a*, 16*b* disposed on the side surface. A plurality of bolts is inserted through the plurality of mounting feet 16*a*, 16*b* to fasten the induced draft fan to a load mounting plate. A squeezing force is exerted by the load mounting plate on the volute body 1 and the cover plate 2, thereby enhancing the leak resistance of the induced draft fan. Each of the plurality of mounting feet 16*a*, 16*b* comprises an arc plate with a round hole or a square column with a kidney-shape hole. The plurality of mounting feet 16*a*, 16*b* may be formed to suitable shape according to the needs, which allows convenient installation of the induced draft fan.

The volute body 1 and the cover plate 2 are formed by injection molding. The convenient process results in a product with a simple structure and high installation accuracy.

Example 2

Referring to FIGS. 16-27, an induced draft fan comprises the volute assembly 10 of Example 1, a wind wheel 90, and a motor 30. The motor 30 is disposed on the top of the volute assembly 10. A front end of a rotating shaft of the motor 30 is inserted into the volute assembly 10 and is connected to the wind wheel 90.

The wind wheel 90 comprises a wheel disk 91, a plurality of blades 92, and a shaft mounting base 911 protrudes from the middle of the wheel disk 91. The shaft mounting base 911 comprises a shaft hole 912. The wheel disk 91 comprises a bottom surface 913 and the plurality of blades 92 is disposed circumferentially at intervals around the shaft mounting base 911 on the bottom surface. An air duct 93 is formed between every two adjacent blades. Each of the plurality of blades comprises a first surface 921 and a second surface 922; the first surface 921 is at least partially inclined relative to the second surface 922 and the bottom surface 913 of the wheel disk 91, which increases the pressure generated by the induced draft fan, makes the pressure and flow rate more uniform, reduces surges in the airflow, and reduces the loss caused by uneven distribution of the airflow in the volute body, thereby improving the operating efficiency of the induced draft fan and reducing noise and vibration of the induced draft fan.

The second surface 922 is perpendicular to the wheel disk 91.

The first surface 921 comprises a parallel surface 9211 and an inclined surface 9212. The parallel surface 9211 is parallel to the second surface 922. The second surface 922 and the inclined surface 9212 form a V-shaped configuration. The second surface 922 and the inclined surface 9212 intersect at an acute angle a. The V-shaped configuration improves the strength of the induced draft fan and increases the pressure generated by the induced draft fan.

When $30° \leq a \leq 45°$ is satisfied, the pressure and flow rate of the air outlet are uniform, thus reducing the surge flow and the airflow loss caused by uneven distribution thereof in the volute body, and improving the operating efficiency of the induced draft fan, reducing noise and vibration of the induced draft fan.

When $a=35°$ is satisfied, the pressure and flow rate of the air outlet are more uniform, thus reducing the surge flow and the airflow loss caused by uneven distribution thereof in the volute body, and improving the operating efficiency of the induced draft fan, reducing noise and vibration of the induced draft fan.

Start points of inclined surfaces of the plurality of blades are disposed along a first circle, and start points of the plurality of blades are disposed along a second circle; and a diameter of the first circle is greater than that of the second circle, which improves the operating efficiency of the induced draft fan and reduces noise and vibration of the induced draft fan.

Each of the plurality of blades 92 comprises a primary blade 923 and a secondary blade 924; an end portion 9240 of the secondary blade 924 is connected to a middle of the primary blade 923. The primary blade 923 is perpendicular to the wheel disk 91. The secondary blade 924 is inclined with respect to the wheel disk 91. The inner surface of the secondary blade 912 is the inclined surface 9212 which reduces the airflow loss caused by uneven distribution thereof in the volute body.

A V-shaped groove 920 is disposed between the primary blade 923 and the secondary blade 924. A depth H1 of the V-shaped groove 920 gradually increases from the end portion of the secondary blade 924 to the outlet between every two adjacent blades. The width of the V-shaped groove 920 gradually narrows from the end portion of the secondary blade 924 to the outlet between every two adjacent blades. The cross-sectional area of the air outlet of the secondary blade gradually increases from the inside out.

An annular plate 94 is disposed on the top of the plurality of blades near the outlet between every two adjacent blades, thus enhancing the structural strength of the wind wheel.

An outer edge of the wheel disk 91 and outer edges of the plurality of blades each comprises an arc segment 903. The arc segment 903 is bent from the cover plate 2 to the volute body 10, so that the center of the air outlet of the wind wheel 90 is closer to the center of the air outlet 6 of the volute body. The arc segment 903 is bent in the same direction as the arc surface of the cover plate 2, which reduces the impact of the airflow on the surface of the volute body, makes the air flow more smoothly, and provides a uniform pressure distribution of airflow in the flow channel.

The plurality of blades 92 is unevenly distributed on the end surface of the wheel disk 91.

It will be obvious to those skilled in the art that changes and modifications may be made, and therefore, the aim in the appended claims is to cover all such changes and modifications.

What is claimed is:

1. A volute assembly, comprising:

a volute body, the volute body comprising a top plate, a side plate protruding axially from an edge of the top plate, a cavity formed by the top plate and the side plate, and an exhaust duct disposed on the side plate and communicating with the cavity;

a cover plate, the cover plate comprising a bottom plate and an annular sleeve surrounding the bottom plate; and a seal;

wherein:

the side plate comprises a first bottom edge and a plurality of clamping blocks disposed at intervals on the first bottom edge;

the annular sleeve comprises a second bottom edge and a flange protruding from the second bottom edge; the flange comprises a plurality of buckles disposed at intervals;

the seal is disposed around the annular sleeve and is supported by the flange;

the side plate is matched with the annular sleeve in shape; when the cover plate is disposed on the volute body, the annular sleeve is nested in the side plate and the plurality of clamping blocks is secured to the plurality of buckles, respectively, to fasten the cover plate to the volute body, whereby the seal abuts against the side plate and the flange, achieving a sealing effect.

2. The volute assembly of claim 1, wherein the flange comprises a first flange protruding radially outward and a second flange protruding from an edge of the first flange; the first flange, the second flange, and an outer wall of the annular sleeve form a groove; the seal is disposed in the groove; the first bottom edge of the side plate comprises a plurality of bosses which is embedded in the groove and abuts against the seal.

3. The volute assembly of claim 2, wherein the annular sleeve is disposed in a middle of the side plate; a junction between an inner surface of the bottom plate and an inner wall of the annular sleeve comprises a first arc surface.

4. The volute assembly of claim 3, wherein a junction between the top plate and the side plate comprises a second arc surface; the first arc surface, the inner wall of the side plate, and the second arc surface form a kidney-shaped surface so that the volute body and the cover plate form a flow channel with a smooth outer surface; and a diameter of the flow channel increases from a volute tongue to an air outlet of the volute body.

5. The volute assembly of claim 4, wherein the annular sleeve comprises a notch near the exhaust duct; and the notch is in the shape of an arc in an angle of view from an outlet of the exhaust duct to the cavity.

6. The volute assembly of claim 5, wherein a guide slope is disposed on the bottom plate behind the notch.

7. The volute assembly of claim 5, wherein the annular sleeve comprises a first flat plate and a second flat plate which is shorter than the first flat plate; a junction between the first flat plate and the second flat plate comprises a third arc surface; and the notch is disposed through the first flat plate, the second flat plate, and the third arc surface.

8. An induced draft fan, comprising the volute assembly of claim 1, a wind wheel, and a motor, wherein the motor is disposed on a top of the volute assembly; a front end of a rotating shaft of the motor is inserted into the volute assembly and is connected to the wind wheel.

9. The induced draft fan of claim 8, wherein the wind wheel comprises a wheel disk, a plurality of blades, and a shaft mounting base protruding from the middle of the wheel disk; the shaft mounting base comprises a shaft hole; the wheel disk comprises a bottom surface and the plurality of blades is disposed circumferentially at intervals around the shaft mounting base on the bottom surface; an air duct is formed between every two adjacent blades; each of the plurality of blades comprises a first surface and a second surface; the first surface is at least partially inclined relative to the second surface and the bottom surface of the wheel disk.

10. The induced draft fan of claim 9, wherein the second surface is perpendicular to the wheel disk.

11. The induced draft fan of claim 10, wherein the first surface comprises a parallel surface and an inclined surface; the parallel surface is parallel to the second surface; the second surface and the inclined surface form a V-shaped configuration; the second surface and the inclined surface intersect at an acute angle a.

12. The induced draft fan of claim 11, wherein $30° \leq a \leq 45°$.

13. The induced draft fan of claim 12, wherein $a=35°$.

14. The induced draft fan of claim 13, wherein start points of inclined surfaces of the plurality of blades are disposed along a first circle, and start points of the plurality of blades are disposed along a second circle; and a diameter of the first circle is greater than that of the second circle.

15. The induced draft fan of claim 11, wherein each of the plurality of blades comprises a primary blade and a secondary blade; an end portion of the secondary blade is connected to a middle of the primary blade; the primary blade is perpendicular to the wheel disk; the secondary blade is inclined with respect to the wheel disk; and an inner surface of the secondary blade is the inclined surface.

16. The induced draft fan of claim 15, wherein a V-shaped groove is disposed between the primary blade and the secondary blade; a depth of the V-shaped groove increases from the end portion of the secondary blade to an outlet between every two adjacent blades; a width of the V-shaped groove narrows from the end portion of the secondary blade to the outlet between every two adjacent blades.

17. The induced draft fan of claim 15, wherein an annular plate is disposed on a top of the plurality of blades near the outlet between every two adjacent blades.

18. The induced draft fan of claim 11, wherein an outer edge of the wheel disk and outer edges of the plurality of blades each comprise an arc segment; the arc segment is bent from the cover plate to the volute body.

19. The induced draft fan of claim 18, wherein the plurality of blades is unevenly distributed on an end surface of the wheel disk.

* * * * *